US011346344B2

(12) United States Patent
Noh et al.

(10) Patent No.: US 11,346,344 B2
(45) Date of Patent: May 31, 2022

(54) VANE ROTARY COMPRESSOR

(71) Applicant: LG ELECTRONICS INC., Seoul (KR)

(72) Inventors: Kiyoul Noh, Seoul (KR); Seokhwan Moon, Seoul (KR); Jinung Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 170 days.

(21) Appl. No.: 16/734,755

(22) Filed: Jan. 6, 2020

(65) Prior Publication Data

US 2020/0271114 A1 Aug. 27, 2020

(30) Foreign Application Priority Data

Feb. 22, 2019 (KR) ..... 10-2019-0021340

(51) Int. Cl.
*F04C 29/12* (2006.01)
*F04C 18/32* (2006.01)
(Continued)

(52) U.S. Cl.
CPC ..... *F04C 18/344* (2013.01); *F04C 29/128* (2013.01); *F04C 23/008* (2013.01);
(Continued)

(58) Field of Classification Search
CPC .... F04C 18/344; F04C 18/321; F04C 29/128; F04C 29/12; F04C 14/26; F04C 28/26; F04C 15/068; F01C 21/106
See application file for complete search history.

(56) References Cited

U.S. PATENT DOCUMENTS 4,512,728 A * 4/1985 Nakano ..... B60H 1/3223 418/213
4,867,658 A 9/1989 Sugita et al.
(Continued)

FOREIGN PATENT DOCUMENTS

EP 3 401 543 11/2018
JP 59-082597 5/1984
(Continued)

OTHER PUBLICATIONS

U.S. Appl. No. 16/734,679, filed Jan. 6, 2020.
(Continued)

*Primary Examiner* — Deming Wan
(74) *Attorney, Agent, or Firm* — Ked & Associates LLP

(57) ABSTRACT

A vane rotary compressor may include a cylinder provided with at least one outlet port; a plurality of bearings coupled to both sides of the cylinder in an axial direction of the cylinder to form a compression space together with the cylinder; a rotational shaft radially supported by the plurality of bearings; a roller rotatably coupled to the rotational shaft and provided with a plurality of vane slots formed in a circumferential direction, each having a first end opened to an outer circumferential surface thereof; a plurality of vanes slidably inserted into the plurality of vane slots of the roller, respectively, and protruding toward an inner circumferential surface of the cylinder to partition the compression space into a plurality of compression chambers, respectively; a discharge valve coupled to the cylinder to open and close the at least one outlet port; and at least one bypass hole formed in at least one of the plurality of bearings or formed in the cylinder to bypass a portion of refrigerant compressed in the compression chamber.

19 Claims, 12 Drawing Sheets

(51) Int. Cl.

| | |
|---|---|
| ***F04C 14/26*** | (2006.01) |
| ***F04C 28/26*** | (2006.01) |
| ***F04C 18/344*** | (2006.01) |
| ***F01C 21/10*** | (2006.01) |
| *F04C 23/00* | (2006.01) |

(52) U.S. Cl.
CPC ..... *F04C 2210/26* (2013.01); *F04C 2240/30* (2013.01); *F04C 2240/40* (2013.01); *F04C 2240/50* (2013.01)

(56) References Cited

U.S. PATENT DOCUMENTS

| | | | | |
|---|---|---|---|---|
| 2005/0175494 | A1* | 8/2005 | Shibamoto ..... | F04B 39/1066 418/160 |
| 2014/0286807 | A1* | 9/2014 | Sekiya ..... | F04C 29/128 418/55.1 |
| 2015/0064042 | A1 | 3/2015 | Shimaguchi et al. | |
| 2018/0080446 | A1 | 3/2018 | Choi et al. | |
| 2018/0328364 | A1 | 11/2018 | Kim et al. | |

FOREIGN PATENT DOCUMENTS

| | | |
|---|---|---|
| JP | 2000-257576 | 9/2000 |
| JP | 2001-295782 | 10/2001 |
| JP | 2002-048080 | 2/2002 |
| JP | 2015-137576 | 7/2015 |
| JP | 2017-082756 | 5/2017 |
| KR | 10-2016-0138750 | 12/2016 |
| KR | 10-2018-0095391 | 8/2018 |
| KR | 10-2018-0116984 | 10/2018 |

OTHER PUBLICATIONS

European Search Report dated Jul. 10, 2020 issued in EP Application No. 20157509.9.
Korean Office Action dated Mar. 20, 2020 issued in Application No. 10-2019-0024256.
Korean Office Action dated Mar. 16, 2020 issued in Application No. 10-2019-0021340.

* cited by examiner

VANE ROTARY COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2019-0021340, filed in Korea on Feb. 22, 2019, the contents of which is incorporated by reference herein in its entirety.

BACKGROUND

1. Field

A compressor, and more particularly, a vane rotary compressor in which a vane protrudes from a roller and is brought into contact with an inner circumferential surface of a cylinder so as to form a compression chamber is disclosed herein.

2. Background

A rotary compressor may be divided into two types, namely, a type in which a vane is slidably inserted into a cylinder to come in contact with a roller, and another type in which a vane is slidably inserted into a roller to come in contact with a cylinder. Normally, the former is referred to as a 'rotary compressor' and the latter is referred to as a 'vane rotary compressor'.

As for a rotary compressor, a vane inserted in a cylinder is pulled out toward a roller by elastic force or back pressure to come into contact with an outer circumferential surface of the roller. On the other hand, for a vane rotary compressor, a vane inserted in a roller rotates together with the roller, and is pulled out by centrifugal force and back pressure to come into contact with an inner circumferential surface of a cylinder.

A rotary compressor independently forms as many compression chambers as a number of vanes per revolution of a roller, and each compression chamber simultaneously performs suction, compression, and discharge strokes. On the other hand, a vane rotary compressor continuously forms as many compression chambers as a number of vanes per revolution of a roller, and each compression chamber sequentially performs suction, compression, and discharge strokes. Accordingly, the vane rotary compressor has a higher compression ratio than the rotary compressor. Therefore, the vane rotary compressor is more suitable for high pressure refrigerants, such as R32, R410a, and CO2, which have low ozone depletion potential (ODP) and global warming index (GWP).

Such a vane rotary compressor s disclosed in U.S. Patent Publication No. 2015/0064042 (hereinafter "Patent Document"), published on Mar. 5, 2015, which is hereby incorporated by reference. The vane rotary compressor disclosed in the Patent Document is a low-pressure type in which suction refrigerant is filled in an inner space of a motor room but discloses a structure in which a plurality of vanes is slidably inserted into a rotating roller.

In the vane rotary compressor disclosed in the Patent Document, the vane rotary compressor includes a plurality of outlet ports, and the plurality of outlet ports is formed at constant intervals along a circumferential direction. The outlet ports are radially formed to penetrate through the inner and outer circumferential surfaces of the cylinder, and discharge valves for opening and closing the respective outlet ports are provided on the outer circumferential surface of the cylinder. Each discharge valve is configured as a reed valve having one end fixed and another end free.

However, the related art vane rotary compressor fails to quickly respond to a pressure change in a compression chamber. Accordingly, reliability of mechanisms is lowered, thereby limiting an operation range of the compressor. For example, in the compressor, an operating pressure of a refrigeration cycle may increase or a liquid refrigerant may be suctioned into the compression chamber, thereby drastically increasing pressure in the compression chamber. in this case, in order to maintain reliability of the compressor, the refrigerant in the compression chamber must be discharged in advance before the compression chamber reaches an outlet port. However, the related art vane rotary compressor is not provided with a separate discharge passage other than the outlet ports, which causes pressure in the compression chamber to excessively rise and reliability for mechanisms to be drastically lowered accordingly. In addition, the operation range of the compressor is limited in consideration of such problems. This may bring about a limit of an operation range of the refrigeration cycle.

Those problems become more serious when a high-pressure refrigerant, such as R32, R410a, or CO2, is used. When the high-pressure refrigerant is used, the same level of cooling capability may be obtained as that when using a relatively low-pressure refrigerant, such as R134a, even though the volume of each compression chamber is reduced by increasing the number of vanes. However, if the number of vanes increases, a compression cycle is shortened and pressure change in a compression chamber is greatly generated. As a result, over-compression in the compression chamber may frequently occur and the above-mentioned problems may occur more frequently.

BRIEF DESCRIPTION OF THE DRAWINGS

Embodiments will be described in detail with reference to the following drawings in which like reference numerals refer to like elements, and wherein:

FIG. 2 is a cross-sectional view taken along line "II-II" of FIG. 1, and FIG. 3 is a cross-sectional view taken along line "III-III" of FIG. 2;

DETAILED DESCRIPTION

Description will now be given of a vane rotary compressor according to embodiments disclosed herein, with reference to the accompanying drawings. For reference, a bypass hole disclosed herein may also be applied to a rotary compressor in which vanes are inserted into a cylinder. In this embodiment, however the vane rotary compressor as disclosed above will be described as an example.

Figure 1:
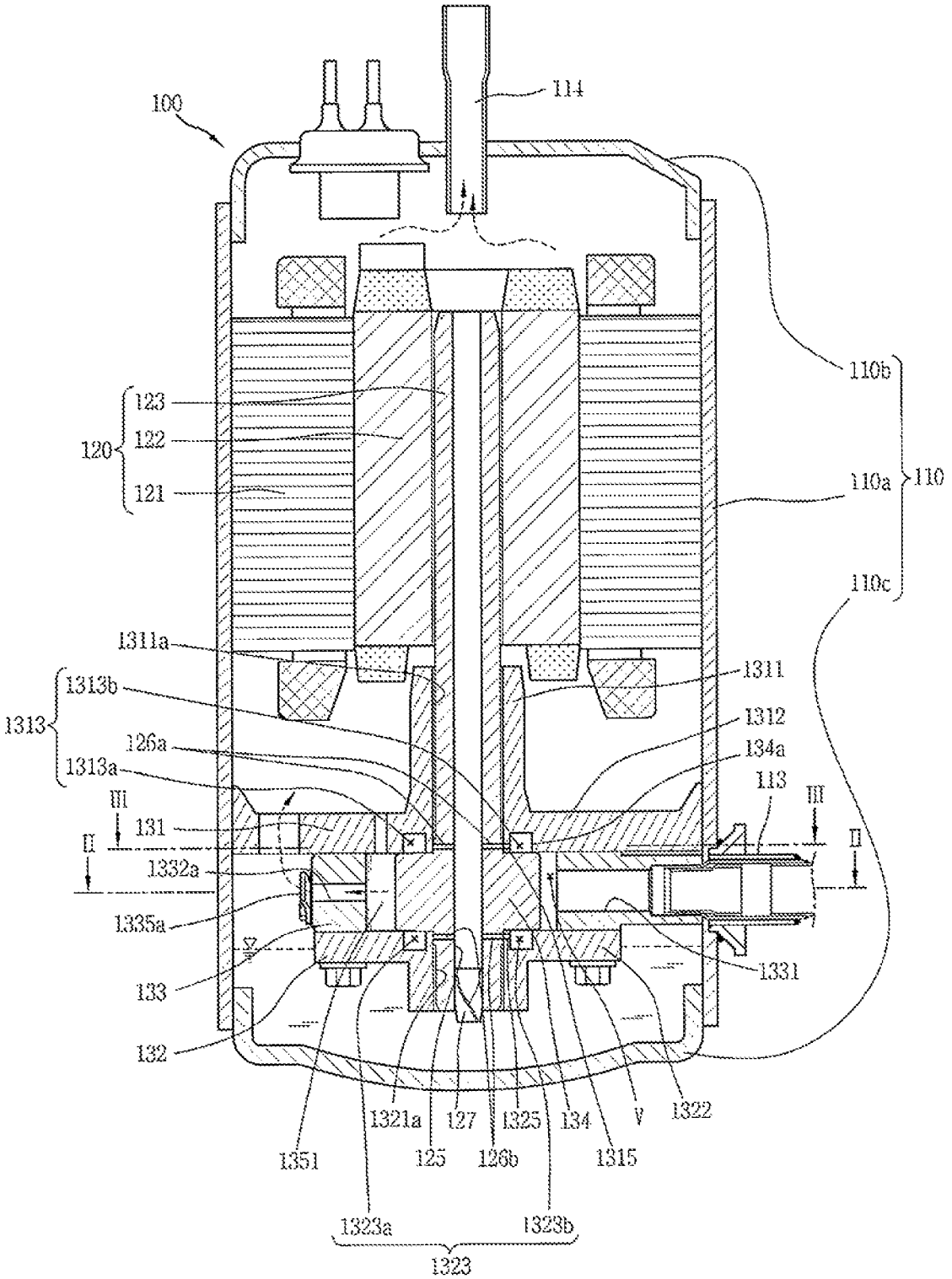
FIG. 1 is a longitudinal cross-sectional view of a vane rotary compressor according to an embodiment.

Referring to FIG. 1, a vane rotary compressor according to an embodiment may include a drive motor 120 installed in a casing 110, and a compression part or unit 130 provided at one side of the drive motor 120 and mechanically connected to the drive motor 120 by a rotational shaft 123.

The casing 110 may be classified as a vertical type or a horizontal type according to a compressor installation method. As for the vertical-type casing, the drive motor and the compression part are disposed at both upper and lower sides along an axial direction. As for the horizontal-type casing, the drive motor and the compression part are disposed at both lateral or left and right sides.

The drive motor 120 provides power for compressing a refrigerant. The drive motor 120 may include a stator 121, a rotor 122 and the rotational shaft 123.

The stator 121 may be fixedly inserted into the casing 110. The stator 121 may be mounted on an inner circumferential surface of the cylindrical casing 110 in a shrink-fitting manner, for example. For example, the stator 121 may be fixedly mounted on an inner circumferential surface of an intermediate shell 110*a*.

The rotor 122 may be disposed spaced apart from the stator 121 and located at an inner side of the stator 121. The rotational shaft 123 may be, for example, press-fitted into a central part or portion of the rotor 122. Accordingly, the rotational shaft 123 coupled to the rotor 122 rotates concentrically together with the rotor 120.

An oil flow path 125 may be formed in a central part or portion of the rotational shaft 123 in an axial direction, and oil passage holes 126*a* and 126*b* may be formed through a middle part or portion of the oil flow path 125 toward an outer circumferential surface of the rotational shaft 123. The oil passage holes 126*a* and 126*b* may include a first oil passage hole 126*a* disposed in a range of a first bearing portion 1311 and a second oil passage hole 126*b* disposed in a range of a second bearing portion 1321. One or a plurality of each of the first oil passage hole 126*a* and the second oil passage hole 126*b* may be provided. This embodiment shows an example in which a plurality of oil passage holes is formed.

An oil feeder 127 may be installed at a middle or lower end of the oil flow path 125. Accordingly, when the rotational shaft 123 rotates, oil filled in a lower part or portion of the casing may be pumped by the oil feeder 127 and suctioned along the oil flow path 125, so as to be introduced into a sub bearing surface 1321*a* with the second bearing portion through the second oil passage hole 126*b* and into a main bearing surface 1311*a* with the second bearing portion through the first oil passage hole 126*a*.

The first oil passage hole 126*a* and the second oil passage hole 126*b* may overlap a first oil groove 1311*b* and a second oil groove 1321*b*, respectively. In this way, oil supplied to the bearing surfaces 1311*a* and 1321*a* of a main bearing 131 and a sub bearing 132 through the first oil passage hole 126*a* and the second oil passage hole 126*b* may be quickly introduced into a main-side second pocket 1313*b* and a sub-side second pocket 1323*b* described hereinafter.

The compression unit 130 may include a cylinder 133 in which a compression space V may be formed by the main bearing 131 and the sub bearing 131 installed on both sides thereof in an axial direction.

Figure 2:
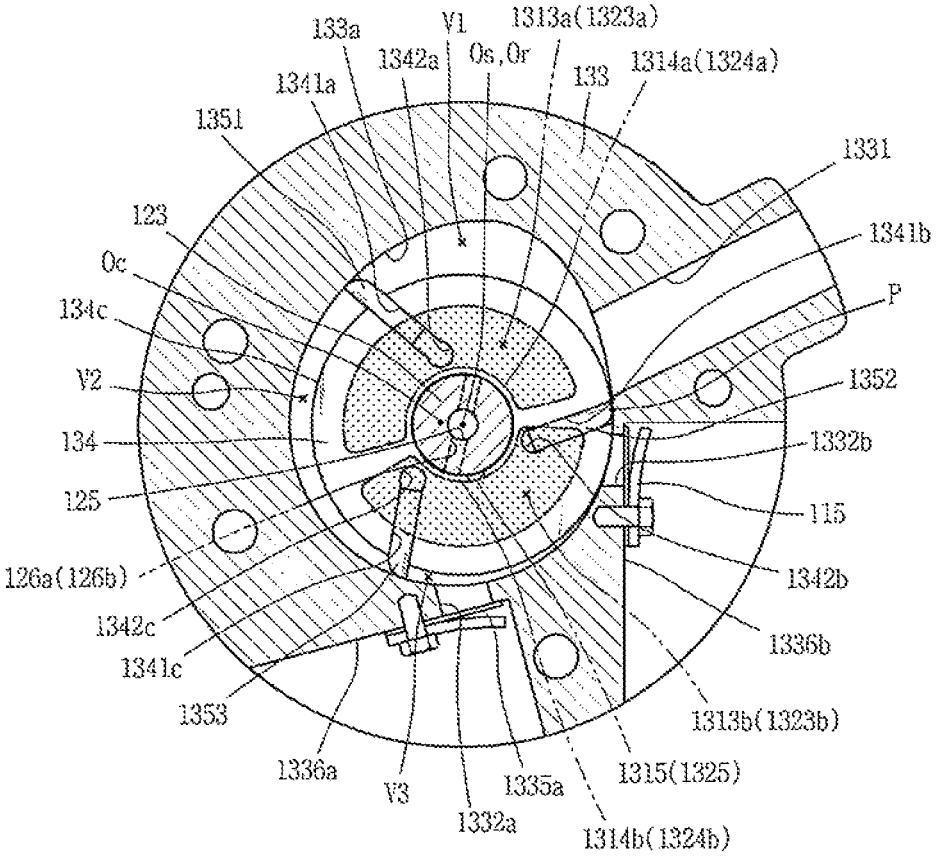
FIGS. 2 and 3 are horizontal cross-sectional views of a compression unit of FIG. 1, namely.

Referring to FIGS. 1 and 2, the main bearing 131 and the sub bearing 132 may be fixedly installed on the casing 110 and spaced apart from each other along the rotational shaft 123. The main bearing 131 and the sub bearing 132 may radially support the rotational shaft 123 and axially support the cylinder 133 and a roller 134 at the same time. As a result, the main bearing 131 and the sub bearing 132 may be provided with a bearing portion 1311, 1321 that radially supports the rotational shaft 123, and a flange portion 1312, 1322 radially extending from the bearing portion 1311, 1321. For convenience of explanation, the bearing portion and the flange portion of the main bearing 131 are defined as the first bearing portion 1311 and the first flange portion 1312, respectively, and the bearing portion and the flange portion of the sub bearing 132 are defined as the second bearing portion 1321 and the second flange portion 1322, receptively.

Figure 3:
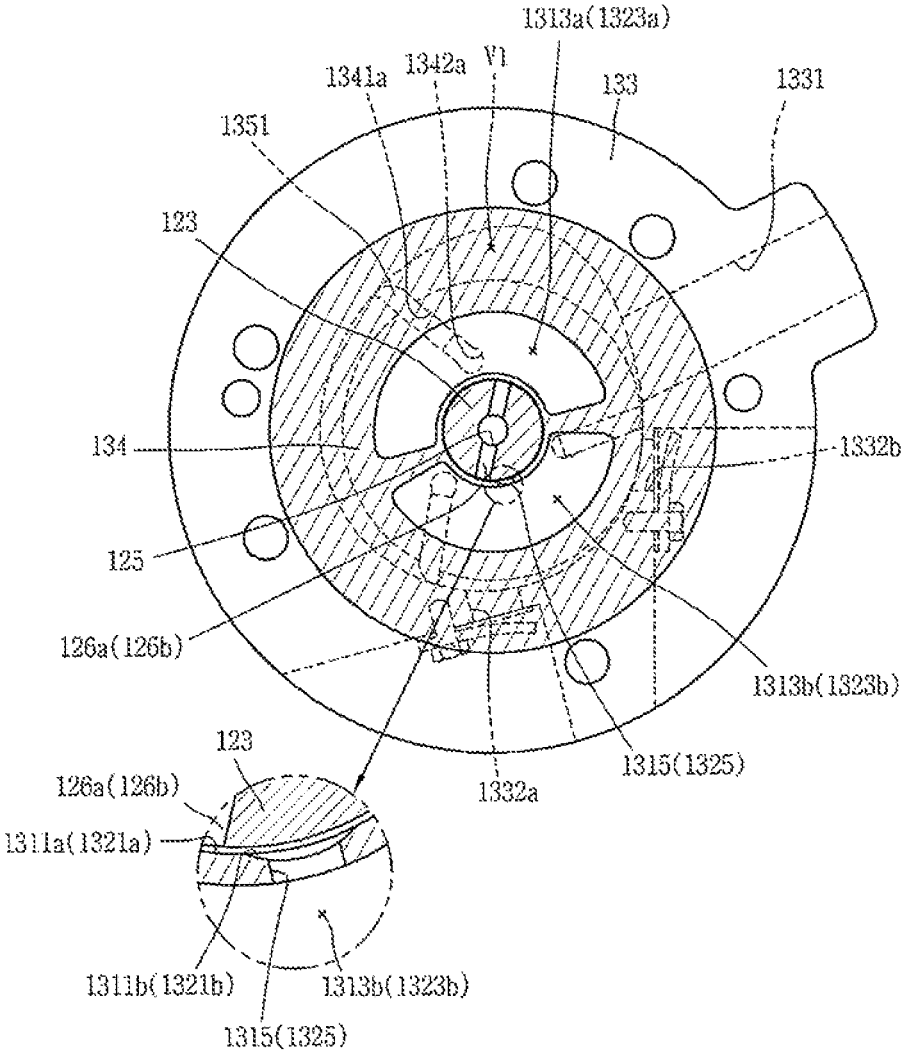

Referring to FIGS. 1 and 3, the first bearing portion 1311 and the second bearing portion 1321 may be formed in a bush shape, respectively, and the first flange portion and the second flange portion may be formed in a disk shape, respectively. A first oil groove 1311*b* may be formed on a radial bearing surface (hereinafter, referred to as "bearing surface", "first bearing surface", or "main bearing surface") 1311*a*, which is an inner circumferential surface of the first bearing portion 1311, and second oil groove 1321*b* may be formed on a radial bearing surface (hereinafter, referred to as "bearing surface", "second bearing surface", or "sub bearing surface") 1321*a*, which is an inner circumferential surface of the second bearing portion 1321. The first oil groove 1311*b* may be formed linearly or diagonally between upper and lower ends of the first bearing portion 1311, and the second oil groove 1321*b* may be formed linearly or diagonally between upper and lower ends of the second bearing portion 1321.

A first communication flow path 1315 described hereinafter may be formed in the first oil groove 1311*b*, and a second communication flow path 1325 described hereinafter may be formed in the second oil groove 1321*b*. The first communication flow path 1315 and the second communication flow path 1325 may guide oil flowing into the respective bearing surfaces 1311*a* and 1321*a* to a main-side back pressure pocket 1313 and a sub-side back pressure pocket 1323. This ill be described hereinafter together with back pressure pockets.

The first flange portion 1312 may be provided with the main-side back pressure pocket 1313, and the second flange portion 1322 may be provided with the sub-side back pressure pocket 1323. The main-side back pressure pocket 1313 may be provided with a main-side first pocket 1313*a* and a main-side second pocket 1313*b*, and the sub-side back pressure pocket 1323 may be provided with a sub-side first pocket 1323*a* and a sub-side second pocket 1323*b*. The main-side first pocket 1313*a* and the main-side second pocket 1313*b* may be formed with a predetermined spacing therebetween along a circumferential direction, and the sub-side first pocket 1323*a* and the sub-side second pocket 1323*b* may be formed with a predetermined spacing therebetween along the circumferential direction.

The main-side first pocket 1313*a* forms a pressure lower than a pressure formed in the main-side second pocket 1313*b*, for example, forms an intermediate pressure between a suction pressure and a discharge pressure. The sub-side first pocket 1323*a* forms a pressure lower than a pressure formed in the sub-side second pocket 1323*b*, for instance, forms an intermediate pressure nearly the same as the pressure of the main-side first pocket 1313*a*. The main-side first pocket 1313*a* forms the intermediate pressure by being decompressed while oil is introduced into the main-side first pocket 1313*a* through a fine or narrow passage between a main-side first bearing protrusion 1314*a* and an upper surface 134*a* of the roller 134 described hereinafter, and the sub-side first pocket 1323*a* also forms the intermediate pressure by being decompressed while oil is introduced into the sub-side first pocket 1323*a* through a fine passage between a sub-side first bearing protrusion 1314*b* and a lower surface 134*b* of the roller 134 described hereinafter. On the other hand, the main-side second pocket 1313*b* and the sub-side second pocket 1323*b* maintain a discharge pressure or a pressure almost equal to discharge pressure as oil, which is introduced into the main bearing surface 1311*a* and the sub bearing surface 1321*a* through the first oil passage hole 126*a* and the second oil passage hole 126*b*, flows into the main-side second pocket 1313*b* and the sub-side second pocket 1323*b* through the first communication flow path 1315 and the second communication flow path 1325 described hereinafter.

An inner circumferential surface, which constitutes compression space V, of cylinder 133 may be formed in an elliptical shape. The inner circumferential surface of the cylinder 133 may be formed in a symmetric elliptical shape having a pair of major and minor axes. However, the inner circumferential surface of the cylinder 133 has an asymmetric elliptical shape having multiple pairs of major and minor axes in this embodiment. This cylinder 133 formed in the asymmetric elliptical shape may be generally referred to as a hybrid cylinder, and this embodiment describes a vane rotary compressor to which such a hybrid cylinder is applied. However, the structure of the back pressure pocket according to embodiments may also be equally applied to the vane rotary compressor having the symmetrical ellipse shape.

As illustrated in FIGS. 2 and 3, an outer circumferential surface of the hybrid cylinder (hereinafter, referred to as "cylinder") 133 according to this embodiment may be formed in a circular shape. However, a non-circular shape may also be applied if it is fixed to an inner circumferential surface of the casing 110. Of course, the main bearing 131 and the sub bearing 132 may be fixed to the inner circumferential surface of the casing 110, and the cylinder 133 may be coupled to the main bearing or the sub bearing 132 fixed to the casing 110 with, for example, a bolt.

In addition, an empty space may be formed at a central portion of the cylinder 133 so as to form compression space V including an inner circumferential surface. This empty space may be sealed by the main bearing 131 and the sub bearing 132 to form the compression space V. The roller 134 described hereinafter may be rotatably coupled to the compression space V.

The inner circumferential surface 133*a* of the cylinder 133 may be provided with an inlet port 1331 and outlet ports 1332*a* and 1332*b* on both sides in a circumferential direction with respect to a point P1 where the inner circumferential surface 133*a* of the cylinder 133 and an outer circumferential surface 134*c* of the roller 134 are almost in contact with each other. The inlet port 1331 may include a first suction part or portion (not shown) formed from the inner circumferential surface 133*a* of the cylinder 133 to an outer circumferential surface, in a penetrating manner, and a second suction part or portion (not shown) extending from one or a first end of the first suction part 1331*a* in a groove shape.

The inlet port 1331 may be directly connected to a suction pipe 113 by a connection pipe (not shown) penetrating through the casing 110. The outlet ports 1332*a* and 1332*b* may communicate with an inner space of the casing 110, thereby being indirectly connected to a discharge pipe 114 coupled to the casing 110 in a penetrating manner. Accordingly, a refrigerant may be suctioned directly into the compression space V through the inlet port 1331 while compressed refrigerant is discharged into the inner space of the casing 110 through the outlet port 1332*a*, 1332*b*, and then discharged to the discharge pipe 114. As a result, the inner space of the casing 110 may be maintained in a high-pressure state forming a discharge pressure.

In addition, the inlet port 1331 may not be provided with an inlet valve, separately, however, the outlet port 1332*a*, 1332*b* may be provided with a discharge valve 1335*a*, 1335*b* that opens and closes the outlet port 1332*a*, 1332*b*. The discharge valve 1335*a*, 1335*b* may be a lead-type valve having one or a first end fixed and another or a second end free. However, various types of valves, such as a piston valve, other than the lead-type valve, may be used as the discharge valve 1335*a*, 1335*b* as necessary.

When the lead-type valve is used for the discharge valve 1335*a*, 1335*b*, a valve groove 1336*a*, 1336*b* may be formed on an outer circumferential surface of the cylinder 133 so as to mount the discharge valve 1335*a*, 1335*b*. Accordingly, a length of the outlet port 1332*a*, 1332*b* may be reduced to a minimum, thereby decreasing in dead volume. The valve groove 1336*a*, 1336*b* may be formed in a triangular shape so as to secure a flat valve seat surface, as illustrated in FIGS. 2 and 3.

On the other hand, a plurality of the outlet port 1332*a*, 1332*b* may be provided along a compression path (compression proceeding direction). For convenience of explanation, an outlet port located at an upstream side of the compression path is referred to as a sub outlet port (or a first outlet port) 1332*a*, and an outlet port located at a downstream side of the compression path is referred to as a main outlet port (or a second outlet port) 1332*b*.

However, the sub outlet port is not necessarily required and may be selectively formed as necessary. For example, the sub outlet port may not be formed on the inner circumferential surface 133*a* of the cylinder 133 if over-compression of a refrigerant is appropriately reduced by setting a long compression period, as will be described hereinafter. However, in order to minimize over-compression of refrigerant, the sub outlet port 1332*a* may be formed ahead of the main outlet port 1332*b*, that is, at an upstream side of the main outlet port 1332*b* based on the compression proceeding direction.

Referring to FIGS. 2 and 3, the roller 134 described above may be rotatably provided in the compression space V of the cylinder 133. An outer circumferential surface 134*c* of the roller 134 may be formed in a circular shape, and the rotational shaft 123 may be integrally coupled to the central part of the roller 134. In this way, the roller 134 has a center Or coinciding with an axial center Os of the rotational shaft 123, and concentrically rotates together with the rotational shaft 123 centering around the center Or of the roller 134.

The center Or of the roller 134 is eccentric with respect to a center Oc of the cylinder 133, that is, a center of the inner space of the cylinder 133 (hereinafter, defined as a center of the cylinder for the sake of explanation), and one side of the outer circumferential'surface 1340 of the roller 134 is almost in contact with the inner circumferential surface 133*a* of the cylinder 133. When an arbitrary point of the cylinder 133 at which one side of the outer circumferential surface of the roller 134 gets closest to the inner circumferential surface of the cylinder 133, and thus, the roller 134 almost comes into contact with the cylinder is referred to as a contact point P, a center line passing through the contact point P and the center of the cylinder 133 may be a position for a minor axis of the elliptical curve forming the inner circumferential surface 133*a* of the cylinder 133.

The roller 134 has a plurality of vane slots 1341*a*, 1341*b*, and 1341*c* formed in the outer circumferential surface thereof at appropriate places along a circumferential direction, Vanes 1351, 1352, and 1353 are slidably inserted into the vane slots 1341*a*, 1341*b*, and 1341*c*, respectively. The vane slots 1341*a*, 1341*b*, and 1341*c* may be formed radially with respect to the center of the roller 134. In this case, however, it is difficult to sufficiently secure a length of the vane. Therefore, the vane slots 1341*a*, 1341*b*, and 1341*c* may be formed to be inclined by a predetermined inclination angle with respect to a radial direction so that the length of the vane may be sufficiently secured.

A direction in which the vanes 1351, 1352 and 1353 are tilted may be an opposite direction to a rotational direction of the roller 134. That is, front surfaces of the vanes 1351, 1352, and 1353 in contact with the inner circumferential surface 133*a* of the cylinder 133 may be tilted in the rotational direction of the roller 134. This allows a compression start angle to be formed ahead in the rotational direction of the roller 134 so that compression may start quickly.

In addition, back pressure chambers 1342*a*, 1342*b*, and 1342*c* may be formed at inner ends of the vane slots 1341*a*, 1341*b*, and 1341*c* respectively, to introduce oil (or refrigerant) into rear sides of the vanes 1351, 1352 and 1353, so as to push each vane toward the inner circumferential surface of the cylinder 133. For convenience, a direction toward the cylinder with respect to a motion direction of the vane is defined as a front side, and an opposite direction is defined as a rear side.

The back pressure chambers 1342*a*, 1342*b* and 1342*c* may be hermetically sealed by the main bearing 131 and the sub bearing 132. The back pressure chambers 1342*a*, 1342*b*, and 1342*c* may independently communicate with the back pressure pockets 1313 and 1323, or the plurality of back pressure chambers 1342*a*, 1342*b* and 1342*c* may be formed to communicate together through the back pressure pockets 1313 and 1323.

The back pressure pockets 1313 and 1323 may be formed in the main bearing 131 and the sub bearing 132, respectively, as shown in FIG. 1. In some cases, however, they may be formed in only one of the main bearing 131 or the sub bearing 132. In this embodiment, the back pressure pockets 1313 and 1323 are formed in both the main bearing 131 and the sub bearing 132. For convenience of explanation, the back pressure pocket formed in the main bearing is referred to as a main-side back pressure pocket 1313, and the back pressure pocket formed in the sub bearing 132 is referred to as a sub-side back pressure pocket 1323.

As described above, the main-side back pressure pocket 1313 is provided with the main-side first pocket 1313*a* and the main-side second pocket 1313*b*, and the sub-side back pressure pocket 1323 is provided with the sub-side first pocket 1323*a* and the sub-side second pocket 1323*b*. Also, the second pockets of both the main-side and the sub-side form a higher pressure compared to the first pockets. Accordingly, the main-side first pocket 1313*a* and the sub-side first pocket 1323*a* communicate with a back pressure chamber of a vane located relatively at an upstream side (in a suction stroke until before a discharge stroke) among those vanes, and the main-side second pocket 1313*b* and the sub-side second pocket 1323*b* communicate with a back pressure chamber of a vane located relatively at a downstream side (in the discharge stroke until before the suction stroke) among those vanes.

As for the vanes 1351, 1352, and 1353, if a vane located most adjacent to the contact point P1 in a compression proceeding direction is defined as a first vane 1351, and the other vanes are sequentially defined as a second vane 1352 and a third vane 1353 from the contact point P1, the first vane 1351, the second vane 1352, and the third vane 1353 are spaced apart from one another by a same circumferential angle. Accordingly, when a compression chamber formed between the first vane 1351 and the second vane 1352 is a first compression chamber V1, a compression chamber formed between the second vane 1352 and the third vane 1353 is a second compression chamber V2, and a compression chamber formed between the third vane 1353 and the first vane 1351 is a third compression chamber V3, all of the compression chambers V1, V2, and V3 have a same volume at a same crank angle.

The vanes 1351, 1352, and 1353 may be formed in a substantially rectangular parallelepiped shape of end surfaces of the vane in a lengthwise direction of the vane, a surface in contact with the inner circumferential surface 133*a* of the cylinder 133 is defined as a front surface of the vane, and a surface facing the back pressure chamber 1342*a*, 1342*b*, 1342*c* is defined as a rear surface of the vane. The front surface of each of the vanes 1351, 1352, and 1353 is curved so as to be in line contact with the inner circumferential surface 133*a* of the cylinder 133, and the rear surface of the vane 1351, 1352 and 1353 is formed flat to be inserted into the back pressure chamber 1342*a*, 1342*b*, 1342*c* to evenly receive back pressure.

In the drawings, unexplained reference numerals 110*b* and 110*c* denote an upper shell and a lower shell, receptively.

In the vane rotary compressor having the hybrid cylinder, when power is applied to the drive motor 120 so that the rotor 122 of the drive motor 120 and the rotational shaft 123 coupled to the rotor 122 rotate together, the roller 134 rotates together with the rotational shaft 123. Then, the vanes 1351, 1352 and 1353 are pulled out from the respective vane slots 1341*a*, 1341*b*, and 1341*c* by a centrifugal force generated due to rotation of the roller 134 and back pressure of the back pressure chambers 1342*a*, 1342*b*, and 1342*c* provided at the rear side of the vanes 1351, 1352, and 1353. Accordingly, the front surface of each of the vanes 1351, 1352, and 1353 is brought into contact with the inner circumferential surface 133*a* of the cylinder 133.

The compression space V of the cylinder 133 is divided by the plurality of vanes 1351, 1352, and 1353 into a plurality of compression chambers (including a suction chamber or a discharge chamber) V1, V2, and V3 as many as the number of vanes 1351, 1352, and 1353. A volume of each compression chamber V1, V2, and V3 changes according to a shape of the inner circumferential surface 133*a* of the cylinder 133 and eccentricity of the roller 134 while moving in response to the rotation of the roller 134. A refrigerant filled in each of the compression chambers V1, V2, and V3 then flows along the roller 134 and the vanes 1351, 1352, and 1353 so as to be suctioned, compressed, and discharged.

This will be described further as follows. FIGS. 4A-4D are cross-sectional views illustrating processes of suctioning, compressing, and discharging a refrigerant in a cylinder according to an embodiment. In FIG. 4A to FIG. 4D, the main bearing is shown. The sub bearing not shown is the same as the main bearing.

Figure 4A:
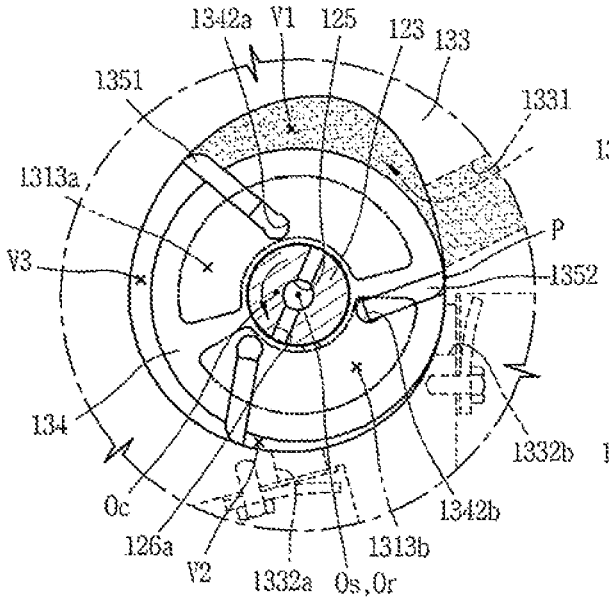
FIGS. 4A-4D are cross-sectional views illustrating processes of suctioning, compressing, and discharging a refrigerant in a cylinder according to an embodiment.

As illustrated in FIG. 4A, the volume of the first compression chamber V1 continuously increases until before the first vane 1351 passes through the inlet port 1331 and the second vane 1352 reaches a suction completion time, so that a refrigerant is continuously introduced into the first compression chamber V1 through the inlet port 1331. At this time, the first back pressure chamber 1342*a* provided at the rear side of the first vane 1351 is exposed to the first pocket 1313*a* of the main-side back pressure pocket 1313, and the second back pressure chamber 1342*b* provided at the rear side of the second vane 1352 is exposed to the second pocket 1313*b* of the main-side back pressure pocket 1313. Accordingly, the first back pressure chamber 1342*a* forms an intermediate pressure and the second back pressure chamber 1342*b* forms a discharge pressure or a pressure almost equal to the discharge pressure (hereinafter, referred to as "discharge pressure"). The first vane 1351 is pressed by the intermediate pressure and the second vane 1352 is pressed by the discharge pressure, respectively, to be brought into close contact with the inner circumferential surface of the cylinder 133.

Figure 4B:
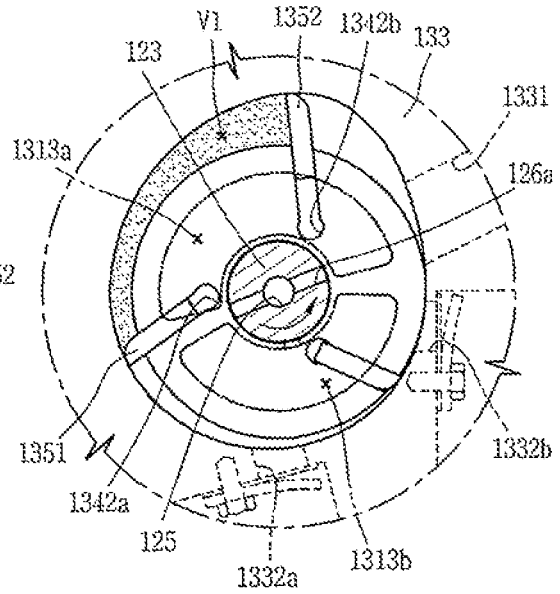

As illustrated in FIG. 4B, when the second vane 1352 starts a compression stroke after passing the suction completion time (or the compression start angle), the first compression chamber V1 is hermetically sealed and moves in a direction toward the outlet port together with the roller 134. During this process, the volume of the first compression chamber V1 is continuously decreased and accordingly a refrigerant in the first compression chamber V1 is gradually compressed.

At this time, when the refrigerant pressure in the first compression chamber V1 rises, the first vane 1351 may be pushed toward the first back pressure chamber 1342*a*. As a result, the first compression chamber V1 communicates with the preceding third chamber V3, which may cause refrigerant leakage. Therefore, a higher back pressure needs to be formed in the first back pressure chamber 1342*a* in order to prevent refrigerant leakage.

Referring to the drawings, the back pressure chamber 1342*a* formed in the rear side of the first vane 1351 is about to enter the main-side second pocket 1313*b* after passing the main-side first pocket 1313*a*. Accordingly, the back pressure formed in the first back pressure chamber 1342*a* of the first vane 1351 immediately rises to discharge pressure from the intermediate pressure. As the back pressure of the first back pressure chamber 1342*a* increases, it is possible to suppress the first vane 1351 from being pushed backwards.

Figure 4C:
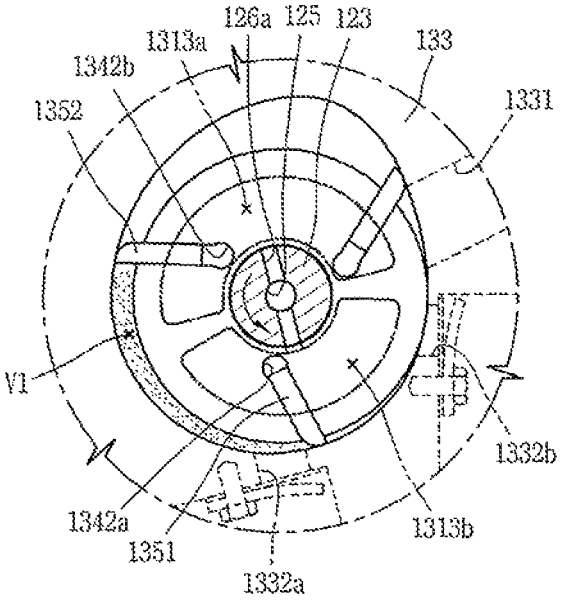

As illustrated in FIG. 4C, when the first vane 1351 passes through the first outlet port 1332*a* and the second vane 1352 has not reached the first outlet port 1332*a*, the first compression chamber V1 communicates with the first outlet port 1332*b* and the second outlet port 1332*b* is opened by pressure of the first compression chamber V1. Then, a portion of refrigerant in the first compression chamber V1 is discharged to the inner space of the casing 110 through the first outlet port 1332*a*, so that the pressure of the first compression chamber V1 is lowered to a predetermined pressure. In the case where the first outlet port 1332*a* is not formed, a refrigerant in the first compression chamber V1 further moves toward the second outlet port 1332*b*, which is the main outlet port, without being discharged from the first compression chamber V1.

At this time, the volume of the first compression chamber V1 is further decreased so that the refrigerant in the first compression chamber V1 is further compressed. However, the first back pressure chamber 1342*a* in which the first vane 1351 is accommodated completely communicates with the main-side second pocket 1313*b* so as to form pressure almost equal to the discharge pressure. Accordingly, the first vane 1351 is not pushed by the back pressure of the first back pressure chamber 1342*a*, thereby suppressing leakage between the compression chambers.

Figure 4D:
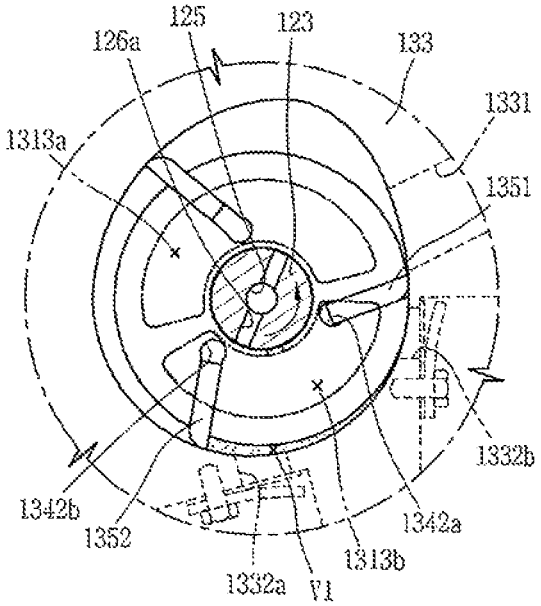

As illustrated in FIG. 4D, when the first vane 1351 passes through the second outlet port 1332*b* and the second vane 1352 reaches a discharge start angle, the second outlet port 1332*b* is opened by refrigerant pressure of the first compression chamber V1. Then, the refrigerant in the first compression chamber V1 is discharged to the inner space of the casing 110 through the second outlet port 1332*b*.

At this time, the back pressure chamber 1342*a* of the first vane 1351 is about to enter the main-side first pocket 1313*a* as an intermediate pressure region after passing the main-side second pocket 1313*b* as a discharge pressure region. Accordingly, back pressure formed in the back pressure chamber 1342*a* of the first vane 1351 is lowered to the intermediate pressure from the discharge pressure. On the other hand, the back pressure chamber 1342*b* formed in the rear side of the second vane 1352 is located in the main-side second pocket 1313*b*, which is the discharge pressure region, and back pressure corresponding to discharge pressure is formed in the second back pressure chamber 1342*b*.

Figure 5:
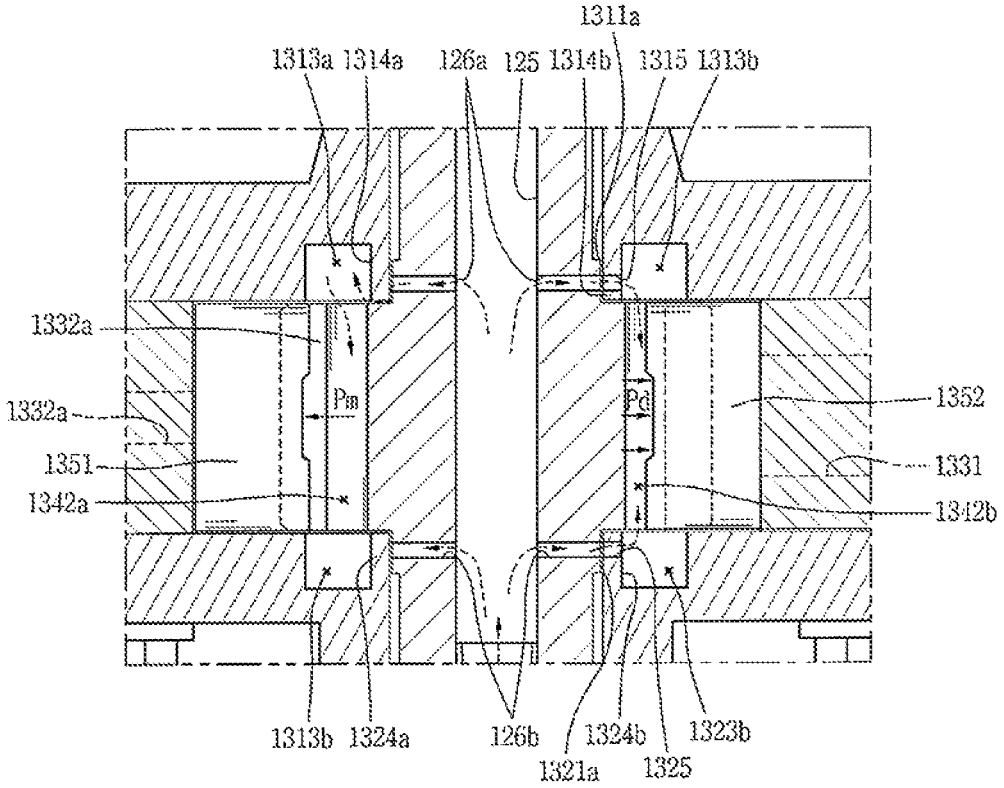
FIG. 5 is a cross-sectional view of a compression unit for explaining back pressure of each back pressure chamber in the vane rotary compressor according to an embodiment.

FIG. 5 is a cross-sectional view of a compression unit for explaining back pressure of each back pressure chamber in the vane rotary compressor according to an embodiment.

Referring to FIG. 5, an intermediate pressure Pm between suction pressure and discharge pressure is formed in the rear end portion of the first vane 1351 to be located in the main-side first pocket 1313*a*, and a discharge pressure (actually, a pressure slightly lower than the discharge pressure) is formed in the rear end portion of the second vane 1352 located in the second pocket 1313*b*. In particular, as the main-side second pocket 1313*b* communicates directly with the oil flow path 125 through the first oil passage hole 126*a* and the first communication flow path 1315, the pressure of the second back pressure chamber 1342*a* communicating with the main-side second pocket 1313*b* may be prevented from rising above the discharge pressure Pd. Accordingly, the intermediate pressure Pm which is much lower than the discharge pressure Pd is formed in the main-side first pocket 1313*a*, and thus, mechanical efficiency between the cylinder 133 and the vane 135 may be enhanced. Also, the discharge pressure Pd or a pressure slightly lower than the discharge pressure Pd is formed in the main-side second pocket 1313*b*, and thus, the vane appropriately comes in close contact with the cylinder, thereby suppressing leakage between compression chambers and enhancing mechanical efficiency.

On the other hand, the first pocket 1313*a* and the second pocket 1313*b* of the main-side back pressure pocket 1313 according to this embodiment communicate with the oil passage 125 through the first oil passage hole 126*a*, and the first pocket 1323*a* and the second pocket 1323*b* of the sub-side back pressure pocket 1323 communicate with the oil passage 125 through the second oil passage hole 126*b*. Referring back to FIGS. 2 and 3, the main-side first pocket 1313*a* and the sub-side first pocket 1323*a* are closed from the bearing surfaces 1311*a* and 1321*a*, which the main and sub-side first pockets 1313*a* and 1323*a* face, by main and sub-side first bearing protrusions 1314*a* and 1324*a*. Accordingly, oil (refrigerant and oil) in the main and sub-side first pockets 1313*a* and 1323*a* flows into the bearing surfaces 1311*a* and 1321*a* through the respective oil passage holes 126*a* and 126*b*. Such oil is decompressed while flowing between the upper surface 134*a* or a lower surface 134*b* of the roller 134 and the main and sub-side first bearing protrusions 1314*a* and 1324*a* both respectively facing the bearing surfaces, so as to form the intermediate pressure.

On the other hand, the main-side second pocket 1313*b* and the sub-side second pocket 1323*b* communicate with the bearing surfaces 1311*a* and 1321*a*, respectively, which the main and sub-side second pockets 13131*b* and 1323*b* face, by the main and sub-side second bearing protrusions 1314*b* and 1324*b*. Accordingly, oil (refrigerant oil) in the main and sub-side second pockets 1313*b* and 1323*b* flows into the bearing surfaces 1311*a* and 1321*a* through the respective oil passage holes 126*a* and 126*b*. Such oil is then introduced into the main and sub-side second pockets 1313*b* and 1323*b*, respectively, through the main and sub-side second bearing protrusions 1314*b* and 1324*b*, so as to form the discharge pressure or the pressure slightly lower than the discharge pressure.

However, the main-side second pocket 1313*b* and the sub-side second pocket 1323*b* according to this embodiment are partially opened to communicate with the bearing surfaces 1311*a* and 1321*a*. That is, the main-side second bearing protrusion 1314*b* and the sub-side second bearing protrusion 1324*b* mostly block the main-side second pocket 1313*b* and the sub-side second pocket 1323*b*, while partially opening the main-side second pocket 1313*b* and the sub-side second pocket 1323*b*, so that the second pockets communicate with the oil passage holes 126*a* and 126*b* through the communication flow paths 1315 and 1325, respectively.

The main-side first pocket 1313*a* and the main-side second pocket 1313*b* are formed in the flange portion 1312 of the main bearing 131 with a predetermined interval along the circumferential direction, and the sub-side first pocket 1323*a* and the sub-side second pocket 1323*b* are formed in the flange portion 1322 of the sub bearing 132 with a predetermined interval along the circumferential direction. Inner circumferential sides of the main-side first pocket 1313*a* and second pocket 1313*b* are blocked by the main-side first bearing protrusion 1314*a* and second bearing protrusion 1314*b*, respectively, and inner circumferential sides of the sub-side first pocket 1323*a* and second pocket 1323*b* are blocked by the sub-side first bearing protrusion 1324*a* and second bearing protrusion 1324*b*, respectively. Accordingly, the bearing portion 1311 of the main bearing 131 has the bearing surface 1311*a* in a cylindrical shape having a substantially continuous surface, and the bearing portion 1321 of the sub bearing 132 has the bearing surface 1321*a* formed in a cylindrical shape having a substantially continuous surface. In addition, the main-side first bearing protrusion 1314*a* and second bearing protrusion 1314*b* and the sub-side first bearing protrusion 1324*a* and second bearing protrusion 1324*b* form a kind of elastic bearing surface.

The first oil groove 1311*b* described above is formed in the bearing surface 1311*a* of the main bearing 131, and the second oil groove 1321*b* described above is formed in the bearing surface 1321*a* of the sub bearing 132. The main-side second bearing protrusion 1314*b* is provided with the first communication flow path 1315 for communicating the main bearing surface 1311*a* with the main-side second pocket 1313*b*. The sub-side second bearing protrusion 1324*b* is provided with the second communication flow path 1325 for communicating the sub bearing surface 1321*a* with the sub-side second pocket 1323*b*.

The first communication flow path 1315 is formed at a position where it overlaps both the main-side second bearing protrusion 1314*b* and the first oil groove 1311*b*, and the second communication flow path 1325 is formed at a position where it overlaps both the sub-side second bearing protrusion 1324*b* and the second oil groove 1321*b*, Also, the first communication flow path 1315 and the second communication flow path 1325, as illustrated in FIG. 5, may be formed as communication holes penetrating through between inner and outer circumferential surfaces of the main and sub-side second bearing protrusions 1314*b* and 1324*b*, respectively, or although not illustrated, may be formed as communication grooves recessed by a predetermined width and depth into end surfaces of the main and sub-side second bearing protrusions 1314*b* and 1324*b*, respectively.

In the vane rotary compressor according to the embodiment as described above, the bearing surfaces which are mostly continuous even at the main-side second pocket 1313*b* and the sub-side second pocket 1323*b*, may stabilize behavior of the rotational shaft 123, thereby enhancing mechanical efficiency of the compressor. The main-side second bearing protrusion 1314*b* and the sub-side second bearing protrusion 1324*b* almost close the main-side second pocket 1313*b* and the sub-side second pocket 1323*b* except for the communication flow paths. Accordingly, the main-side second pocket 1313*b* and the sub-side second pocket 1323*b* maintain a constant volume. As a result, pressure pulsation of the back pressure supporting the vane in the main-side second pocket 1313*b* and the sub-side second pocket 1323*b* may be lowered to stabilize the behavior of the vane and simultaneously suppress vibration of the vane. Accordingly, collision noise between the vane and the cylinder and leakage between compression chambers may be reduced, thereby enhancing compression efficiency.

In addition, even during a long operation, foreign substances may be prevented from being introduced into the main-side second pocket 1313*b* and the sub-side second pocket 1323*b* and flow and accumulate between the bearing surfaces 1311*a* and 1321*a* and the rotational shaft 123, thereby suppressing wear of the bearings 131 and 132 or the rotational shaft 123.

In addition, the vane rotary compressor according to the embodiment further increase surface pressure for bearings when using a high-pressure refrigerant such as R32, R410a, or CO2, than when using an intermediate or low-pressure refrigerant, such as R134a. However, the supporting force for the rotational shaft 123 in a radial direction may increase. In addition, in the case of using a high-pressure refrigerant, surface pressure on vanes may also increase to cause leakage or vibration (shaking) between compression chambers, but proper contact force between the vanes 1351, 1352, and 1353 and the cylinder 133 may be maintained by appropriately maintaining back pressure of back pressure chambers according to the respective vanes. In addition, the vane rotary compressor according to the embodiment may optimize a vibration distance of vanes by maintaining a minimum distance between the front surfaces of the vanes 1351, 1352, and 1353 and the inner circumferential surface of the cylinder 133 (hereinafter, referred to as a "front interval"), As a result, leakage between compression chambers may be suppressed, and noise and abrasion (wear) during vibration of the vanes may be suppressed. This may result in enhancing reliability of the vane rotary compressor using the high-pressure refrigerant.

Also, the vane rotary compressor according to the embodiment may increase the supporting force for the rotational shaft in the radial direction even under a heating low-temperature operation condition, a high-pressure ratio condition, and a high-speed operation condition. In addition, a vibration distance of each vane may be optimized by maintaining a minimum distance between the front surface of the vane 1351, 1352, 1353 and the inner circumferential surface of the cylinder 133, thereby suppressing leakage between compression chambers and also preventing noise and wear caused due to vibration of the vane.

On the other hand, in the vane rotary compressor according to the embodiment, as described above, the plurality of outlet ports is provided, and the plurality of outlet ports is disposed at a predetermined interval along the circumferential direction. However, the related art vane rotary compressor is not provided with a separate discharge passage except for the outlet ports, and thereby, fails to rapidly respond to pressure change in a compression chamber. This may bring about lowered reliability for the compression part. In addition, an operation range (area) of the compressor may be limited. This problem may become more serious when a high-pressure refrigerant, such as R32, R410a or CO2, is used.

Accordingly, in the vane rotary compressor according to the embodiment, a separate discharge passage may be formed in addition to the outlet ports, to prevent over-compression in a compression chamber in advance, thereby enhancing reliability of the compressor and expanding an operation range. Further, in the case of using the high-pressure refrigerant, such as R32, R410a, or CO2, the reliability of the compressor may be enhanced and the operation range may be expanded by maintaining proper pressure in the compression chamber.

To this end, in the embodiment disclosed herein, a through hole which forms a bypass hole may be formed at an upstream side rather than an outlet port based on the rotational direction of the roller. The through hole may be formed from an inner surface as a lower surface to an outer surface as an upper surface of the main frame in a penetrating manner, or from an inner surface as an upper surface to an outer surface as a lower surface of the sub frame in a penetrating manner. The through hole may be formed to have an always-open structure because a discharge valve is not provided, unlike the outlet port which is opened and closed by the discharge valve. Of course, the bypass hole may be partially opened or closed by a valve, but at least part of the bypass hole may be located outside of a range of a valve. Thus, the bypass hole may include an always-open part. In this way, when aver-compression occurs in a compression chamber, a refrigerant in the compression chamber may be quickly discharged from the compression chamber before the compression chamber reaches the outlet port, thereby preventing over-compression of the compression chamber as described above.

Figure 6:
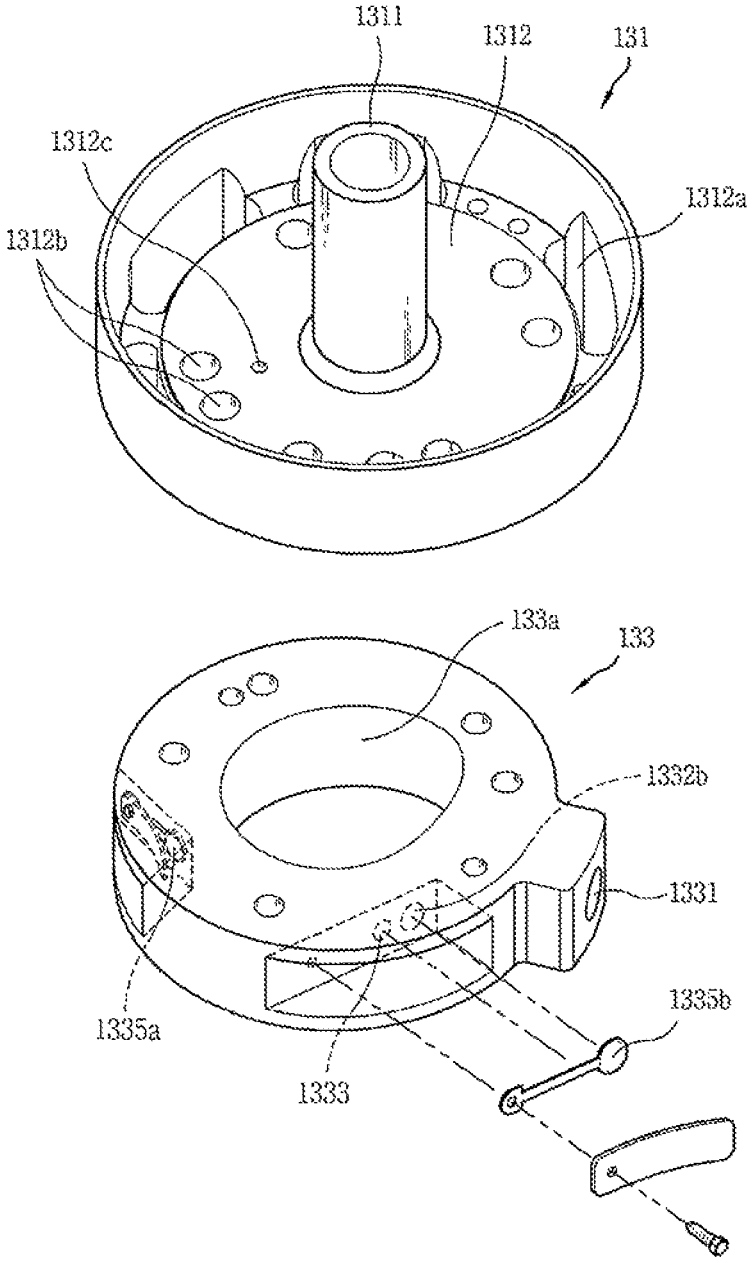
FIG. 6 is a perspective view illustrating a main bearing and a cylinder detached from a compression unit in accordance with an embodiment.
Figure 7:
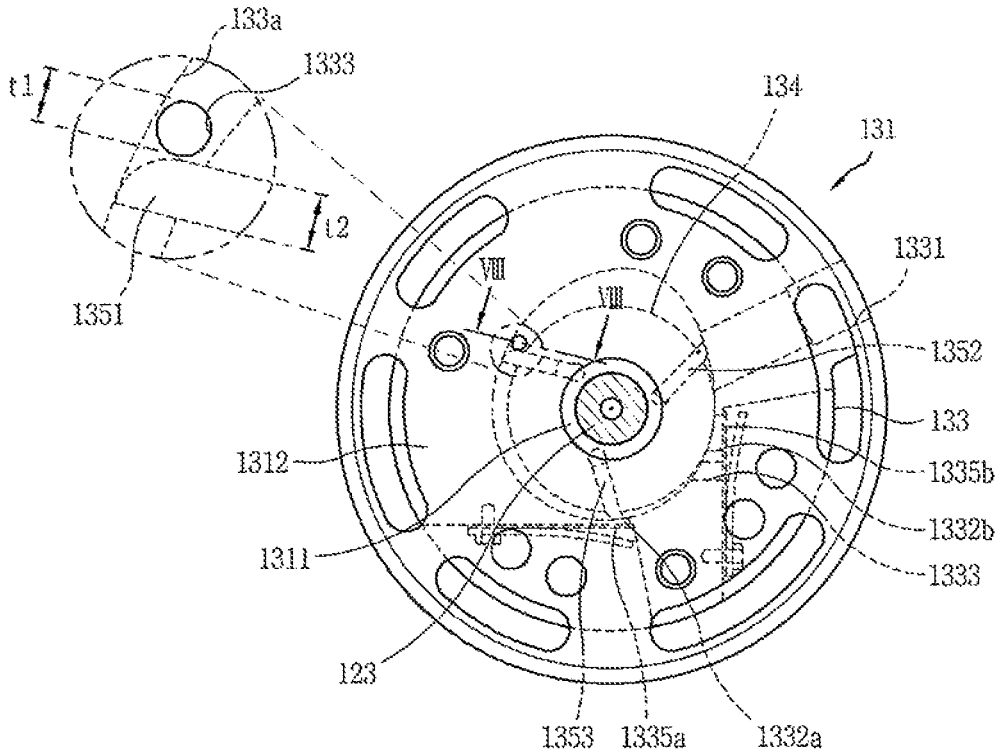
FIG. 7 is a planar view illustrating the main bearing and the cylinder illustrated in FIG. 6 in an assembled state, viewed from a top.
Figure 8:
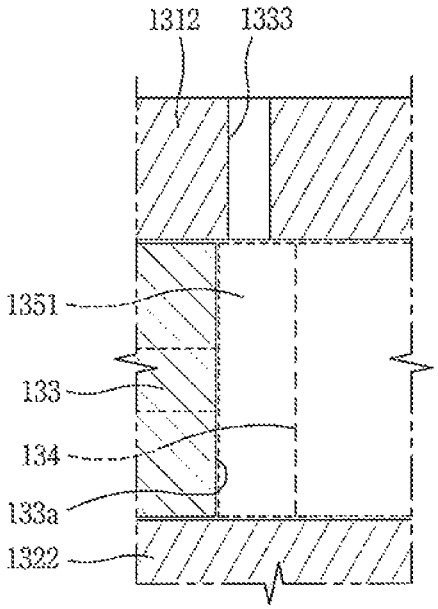
FIG. 8 is a sectional view taken along the line "VIII-VIII" of FIG. 7.

FIG. 6 is a perspective view illustrating a main bearing and a cylinder detached from a compression part according to an embodiment. FIG. 7 is a planar view illustrating the main bearing and the cylinder illustrated in FIG. 6 in an assembled state, viewed from a top. FIG. 8 is a cross-sectional view taken along line "VIII-VIII" of FIG. 7. In FIG. 6, a roller and vanes are not included in the drawings because they do not greatly contribute to explain the embodiment.

Referring to these drawings, in the compression part of the vane rotary compressor according to an embodiment disclosed herein, the main bearing 131 and the sub bearing 132 are coupled to both sides of the cylinder 133, respectively, in the axial direction of the cylinder 133, the roller 134 provided on the rotational shaft 123 is rotatably provided in the cylinder 133, and the plurality of vanes 1351, 1352, and 1353 is slidably coupled to the roller 134 in the circumferential direction. Accordingly, the compression chambers V1, V2, and V3 constituting the compression space V are formed by a bottom surface of the main bearing 131, an upper surface of the sub bearing 132, an inner circumferential surface of the cylinder 133, an outer circumferential surface of the roller 134, and side surfaces of the vanes 1351, 1352, and 1353.

The main bearing 131 is provided with the bearing portion 1311 supporting the rotational shaft 123 in the radial direction, and the flange portion 1312 extending radially from the bearing portion 1311 to form the compression space V. The bearing portion 1311 is formed in a bush shape, and the flange portion 1312 is formed in a disc shape.

The flange portion 1312 is provided with fluid passages 1312*a* formed therethrough around an edge along a circumferential direction, and a plurality of coupling holes 1312*b* formed at a position closer to a center thereof rather than the fluid passage 1312*a*, to couple the main bearing 131 and the cylinder 133 to each other. The plurality of coupling holes 1312*b* may be formed at a predetermined interval along the circumferential direction, and at least one first bypass hole 1312*c* for bypassing some of refrigerant compressed in a compression chamber is formed near one of the plurality of coupling holes 1312*a*.

The first bypass hole 1312*c* may be located at a position closer to the center rather than the corresponding coupling hole 1312*b*. For example, as the coupling hole 1312*b* provided in the main bearing 131 must be axially aligned with a coupling hole (no reference numeral given) provided in the cylinder 133, the coupling hole 1312*b* provided in the main bearing 131 may be located between the inner and outer circumferential surfaces of the cylinder 133 when projected in the axial direction. As the first bypass hole 1312*c* must communicate with the compression chamber V1, V2, and V3, the first bypass hole 1312*c* may be formed through the main bearing 131 in the axial direction at a position close to the center relative to the inner circumferential surface of the cylinder 133, namely, at a position close to the center relative to the coupling hole 1312*b*. However, the first bypass hole 1312*c* may alternatively be formed to be inclined so that one or a first end is located within the compression chamber V1, V2, and V3 and another or a second end is located outside the compression chamber V1, V2, V3.

In addition, the first bypass hole 1312*c* may be formed as a round hole having a same inner diameter. When the first bypass hole 1312*c* has the round shape, it is easily manufactured. However, the first bypass hole 1312*c* is not necessarily formed as a round hole. For example, the first bypass hole 1312*c* may be formed in an elliptic shape or may be formed in a long hole shape. Alternatively, the first bypass hole 1312*c* may be formed in an angular shape, such as a rectangle.

Also, as illustrated in FIGS. 7 and 8, an inner diameter (more precisely, a length in the circumferential direction (circumferential length)) V1 of the first bypass hole 1312*c* may be smaller than or equal to a width t2 of the vane (also called a thickness of the vane). As a result, the compression chambers V1 to V3 formed at both sides of the vane 1351, 1352, 1353 may communicate with each other by the first bypass hole 1312*c*, thereby preventing an occurrence of compression loss.

However, if the circumferential length of the first bypass hole 1312*c* is smaller than or equal to the width t2 of the vane, a flow path area of the first bypass hole 1312*c* may be limited. Accordingly, the first bypass hole 1312*c* may be formed in a long hole shape in which a length in a radial direction (more precisely, in a lengthwise direction of the vane) is greater than the width t2 of the vane although the circumferential length t1 is smaller than or equal to the width t2 of the vane. As a result, the circumferential length t1 of the first bypass hole 1312*c* is smaller than or equal to the thickness t2 of the vane, but a cross-sectional area of the first bypass hole 1312*c* may be enlarged to secure a wider bypass flow path area. This can allow the refrigerant in the compression chamber to be bypassed quickly.

Figure 9:
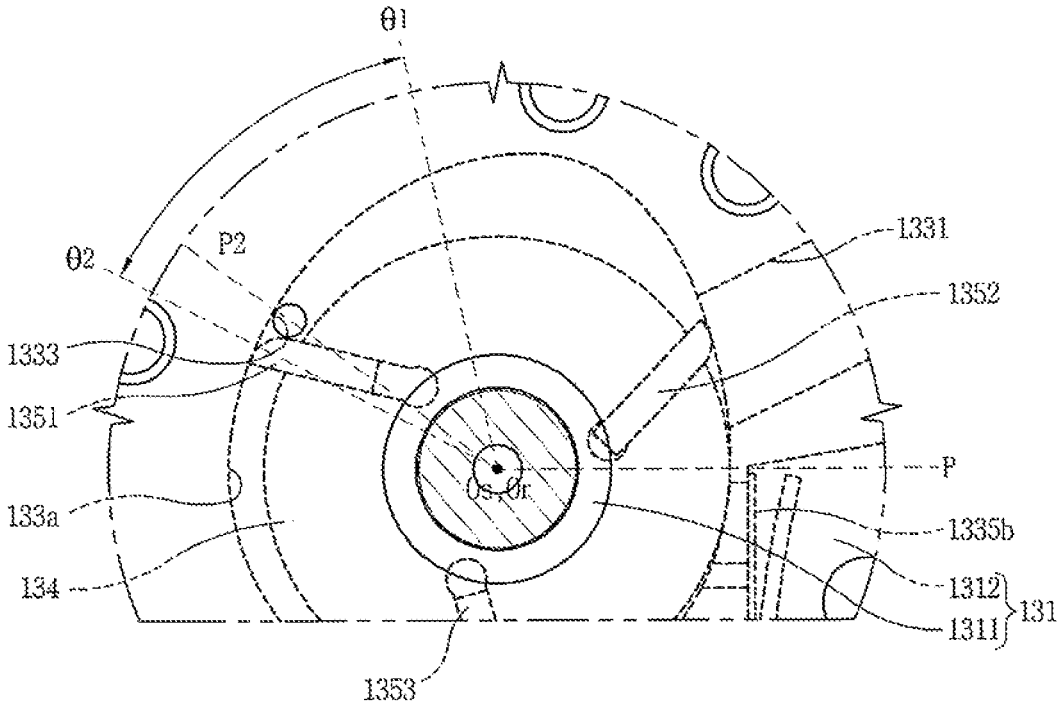
FIG. 9 is a schematic view illustrating a position of a first bypass hole in accordance with an embodiment.

Also, the first bypass hole 1312*c* may be formed at a position where it communicates with the compression chamber while a compression stroke is carried out in the compression chamber. This position is defined as a first position or a first position range. The first position is a position existing between a point where a suction stroke for the compression chamber is completed and a point where a discharge stroke is started. FIG. 9 is a schematic view illustrating a position of a first bypass hole according to an embodiment.

Referring to FIG. 9, a first position P2, which is a position where the first bypass hole 1312*c* is formed, is a position that satisfies $\theta 1 \leq P2 \leq \theta 2$. This means a range defined under the reference that a contact point P, which is a position where the outer circumferential surface of the roller 134 is located closest to the inner circumferential surface of the cylinder 133, is 0° (degree), θ1 is [360/the number of vanes (n)], and θ2 is [θ1+a suction complete position angle of a (first) vane from the contact point P based on a rotational direction of the rotational shaft].

Figure 10:
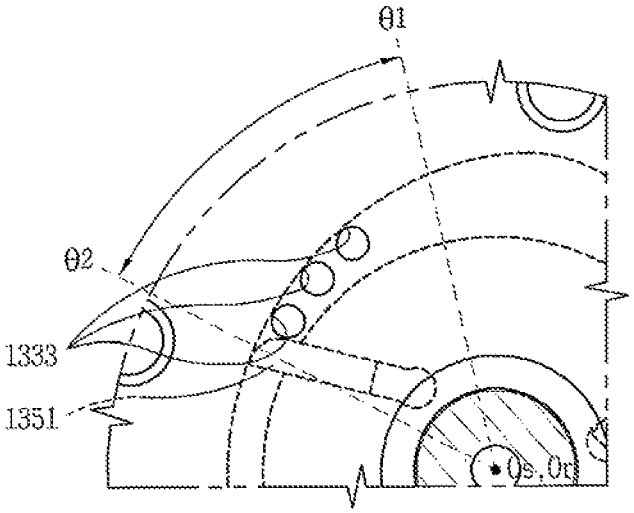
FIG. 10 is a planar view illustrating another embodiment of the first bypass hole.

FIGS. 6 to 9 illustrate one example in which one first bypass hole 1312*c* is provided. However, in some cases, a plurality of the first bypass hole 1312*c* may be provided. FIG. 10 is a planar view illustrating another embodiment of the first bypass hole.

As illustrated in FIG. 18, a plurality of the first bypass holes 1312*c* may be formed within the range of the first position P2 described above, that is, in the range of $\theta 1 \leq P2 \leq \theta 2$. The plurality of first bypass holes 1312*c* may be disposed at a predetermined interval along the circumferential direction. However, the plurality of first bypass holes 1312*c* may be formed such that an interval between the neighboring first bypass holes is greater than or equal to a thickness of the vanes 1351 to 1353. This may prevent the first bypass holes 1312*c* from being blocked by the vanes 1351 to 1353.

Although not shown in the drawings, the first bypass hole (not shown) may also be formed in the sub bearing 132. Even in this case, the first bypass hole may be formed in the same manner as the first bypass hole 1312*c* provided in the main bearing 131, and thus, repetitive description has been omitted.

On the other hand, a second bypass hole 1333 may be further formed in the cylinder 33. As described above, the plurality of outlet ports 1332*a* and 1332*b* may be formed in the cylinder 133 at the predetermined interval along the rotational direction of the roller 134. For example, the first outlet port 1332*a* constituting the sub outlet port may be formed at a front position which is upstream from the inlet port 1331 based on the rotational direction of the roller 134, and the second outlet port 1332*b* constituting the main outlet port may be formed at a rear position which is downstream relative to the first outlet port 1332*a*. However, as the first outlet port 1332*a* corresponds to an additional outlet port, and the second outlet port 1332*b* forms a substantial outlet port, refrigerants in the compression chambers V1 to V3 may be discharged finally through the second outlet port 1332*b*. Accordingly, a plurality of compression chambers may be formed in sequence along the circumferential direction by the number of vanes 1351 to 1353 for each rotation of the roller 134 (or the rotational shaft).

A first discharge valve 1335*a* may be provided at the first outlet port 1332*a* and a second discharge valve 1335*b* may be provided at the second outlet port 1332*b*, respectively. The first discharge valve 1335*a* and the second discharge valve 1335*b* may be each reed type valve. As the first discharge valve 1335*a* and the second discharge valve 1335*b* are formed in the same shape, the following description will be given with reference to the second outlet port and the second discharge valve in association with the second bypass hole.

Figure 11:
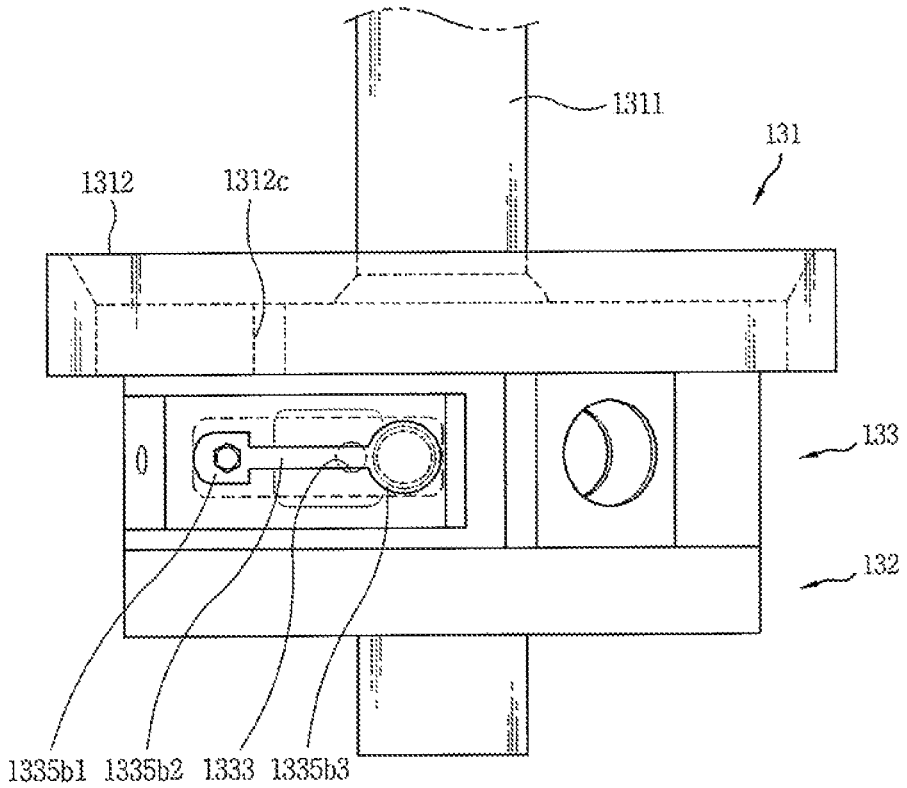
FIG. 11 is a front view of a compression unit in accordance with an embodiment.
Figure 12:
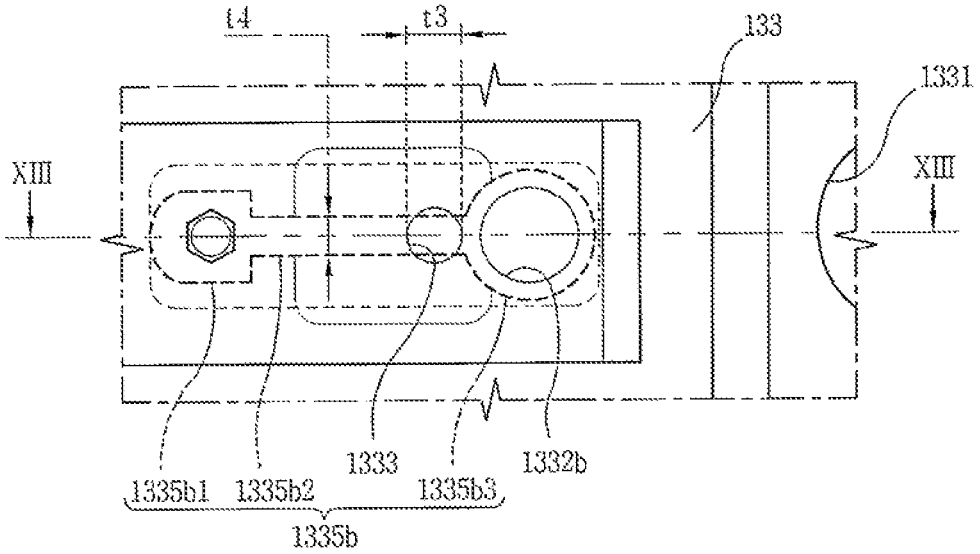
FIG. 12 is an enlarged front view illustrating a periphery of a second outlet port in FIG. 11.
Figure 13:
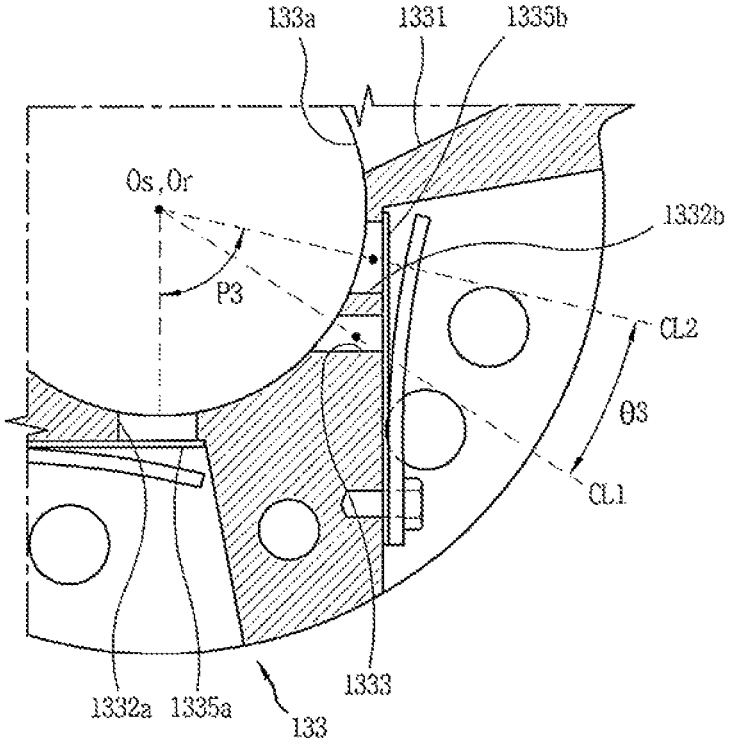
FIG. 13 is a cross-sectional view taken along the line "XIII-XIII" of FIG. 12.

FIG. 11 is a front view of the compression unit according to an embodiment. FIG. 12 is an enlarged front view illustrating a periphery of the second outlet port in FIG. 11. FIG. 13 is a cross-sectional view taken along line "XIII-XIII" of FIG. 12.

Referring to FIGS. 11 and 12, the second bypass hole 1333 according to this embodiment may be formed at a position where it communicates with compression chamber while a discharge stroke is carried out in the compression chamber. This may be defined as a second position P3 or a second position range.

The second position P3 is a position existing between the second outlet port 1332*b* and the first outlet port 1332*a* closest to the second outlet port 1332*b*. For example, the second position P3 is a range in which an angle θ3 between a normal center line CL1 of the second position and a normal center line CL2 of the second outlet port 1332*b* is defined within approximately 25° (degrees).

The second bypass hole 1333 may be formed such that a center thereof is located on a same line as a center of the second outlet port 1332*b* in the circumferential direction. However, in this case, the second bypass hole 1333 may be completely blocked by the second discharge valve 1335*b*. Therefore, the second bypass hole 1333 may be formed so that at least part thereof is located outside of an opening and closing range of the second discharge valve 1335*b*.

For example, as illustrated in FIGS. 12 and 13, an inner diameter t3 of the second bypass hole 1333 may be greater than a width t4 of a portion of the second discharge valve 1335*b* which overlaps the second bypass hole 1333. That is, the second discharge valve 1335*b* according to this embodiment tray include a fixed part or portion 1335*b*1 having one or a first end fixed to the cylinder 133, an elastic part or portion 1335*b*2 that extends from the fixed part 1335*b*1, and an opening and closing part or portion 1335*b*3 that extends from the elastic part 1335*b*2 to open and close the second outlet port 1332*b*.

In this case, the second bypass hole 1333 may be formed at a position where at least a part or portion thereof overlaps the elastic part 1335*b*2 of the second discharge valve 1335*b*.

An inner diameter t3 of the second bypass hole 1333 may be greater than or equal to a width t4 of the elastic part 1335*b*2 of the second discharge valve 1335*b*. Accordingly, the second bypass hole 1333 may be formed to have an area larger than or at least the same as an area of the first bypass hole 1312*c*.

As described above, the second bypass hole 1333 may be formed such that at least a part or portion thereof is always opened without being completely closed by the second outlet port 1332*b* while its center is located on the same line as the center of the second outlet port 1332*b* in the circumferential direction. Then, before the pressure of the compression chamber pushes the second discharge valve 1335*b* to open the second outlet port 1332*b*, the refrigerant compressed in the compression chamber may partially be bypassed to the second bypass hole 1333.

Figure 14:
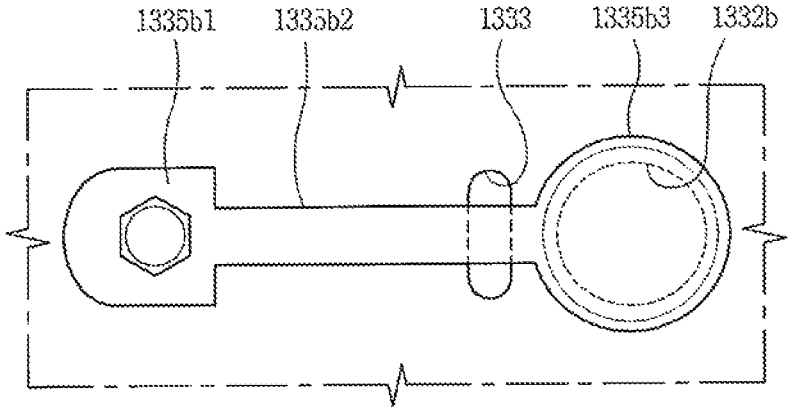
FIGS. 14 and 15 are schematic views illustrating other embodiments of a second bypass hole.
Figure 15:
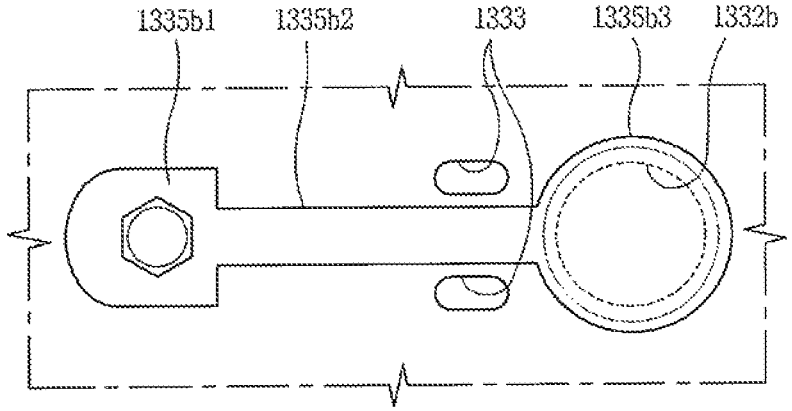

The second bypass hole 1333 may be formed in a round shape, but in some cases, may be formed in an ellipse or a long hole shape. FIGS. 14 and 15 are schematic views illustrating other embodiments of the second bypass hole.

Referring to FIG. 14, the second bypass hole 1333 may be formed in a long hole shape which is long in the axial direction. In this case, a cross-sectional area of the second bypass hole 1333 may be enlarged to the maximum while reducing a circumferential length t5 of the second bypass hole 1333 to the minimum. As a result, the second bypass hole 1333 may have an increased area which is opened without being closed by the second discharge valve 1335*b* even if overlapping the second discharge valve 1335*b*, so that refrigerant in a corresponding compression chamber may be quickly bypassed. In this case, a position of the second bypass hole in the circumferential direction may be freely moved as compared with the foregoing embodiment, which may result in enhancing a degree of freedom for designing the second bypass hole.

A plurality of the second bypass hole 1333 may alternatively be provided. In this case, the second bypass hole 1333 may be formed at a position where it does not overlap the second discharge valve 1335*b*. For example, as illustrated in FIG. 15, the second bypass holes 1333 may be formed at both sides of the elastic part of the second valve 1335*b* in the axial direction, respectively. In this case, the second bypass hole 1333 may be formed in a long hole shape which is long in the circumferential direction. Although not illustrated in the drawing, in this case, the second bypass hole 1333 may be formed in a round shape. Although not illustrated in the drawings, the second bypass hole may alternatively be formed at one side of the elastic part in the axial direction.

As described above, when a plurality of the second bypass hole 1333 is provided, the second discharge valve 1335*b* is not affected by the refrigerant bypassed through the second bypass holes 1333. Therefore, the behavior of the second discharge valve may be stabilized and a dead volume caused by the second bypass holes may be reduced.

On the other hand, the cross-sectional area of the second bypass hole 1333 may be smaller than the cross-sectional area of the second outlet port 1332*b*. In addition, when the cross-sectional area of the second outlet port 1332*b* and the cross-sectional area of the first outlet port 1332*a* are different from each other, the cross-sectional area of the second bypass hole 1333 may be smaller than the cross-sectional area of the first outlet port 1332*a*. This may suppress excessive bypass of the refrigerant in the compression chamber, thereby reducing compression loss.

Although not illustrated in the drawings, the second bypass holes 1333 may also be formed around the first outlet port 1332*a*. The second bypass holes 1333 provided around the first outlet port 1332*a* may be the same as the second bypass holes 1333 provided around the second outlet port 1332*b*. However, when the second bypass holes 1333 are formed around the first outlet port 1332*a*, the refrigerant in the compression chamber may be bypassed before reaching a preset or predetermined discharge pressure, thereby causing compression loss. Or, the second bypass hole 1333 and the first bypass hole 1312*c* may be located close to each other, and the two bypass holes may simultaneously communicate with one compression chamber. As a result, the refrigerant in the compression chamber may be excessively bypassed, thereby causing compression loss.

Hereinafter, description will be given of operation effects of the bypass hole in the vane rotary compressor according to the embodiment. FIGS. 16A-16D are schematic views illustrating a process in which a refrigerant in a compression chamber is bypassed through a first bypass hole and a second bypass hole in a vane rotary compressor according to an embodiment.

FIGS. 16A-16D illustrates a state in which both the first bypass hole 1312*c* and the second bypass hole 1333 are closed from the compression chamber. As shown therein, the succeeding vane 1352 has not yet reached a start end of the inlet port 1331. Then, a first compression chamber V1 which is a corresponding compression chamber to be described hereinafter is formed at the rear of the preceding vane 1351 between the preceding vane 1351 and the contact point P. This is a state where the succeeding vane 1352 has not passed through the inlet port 1331 yet, namely, corresponds to a state where the first compression chamber V1 is performing a suction stroke. As a result, the preceding vane 1351 has not yet passed through the first bypass hole 1312*c*, and thus, the refrigerant is suctioned into the first compression chamber V1 only through the inlet port.

Figure 16A:
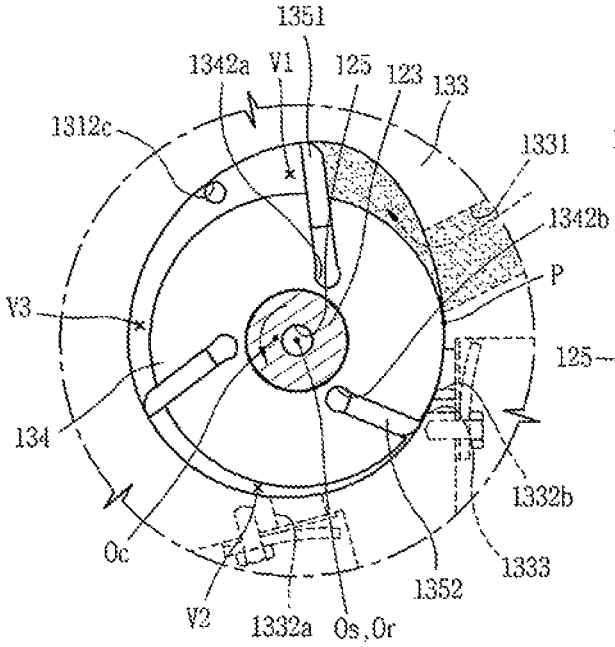
FIGS. 16A-16D are schematic views illustrating a process in which a refrigerant in a compression chamber is bypassed through a first bypass hole and a second bypass hole in a vane rotary compressor in accordance with an embodiment.
Figure 16B:
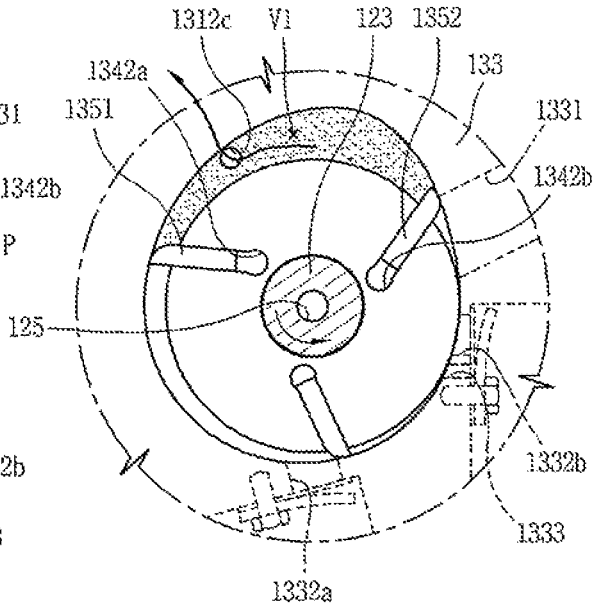

FIG. 16B illustrates a view showing a state in which the first bypass hole 1312*c* is opened. As illustrated therein, the succeeding vane 1352 has just passed through an end of the inlet port 1331. Then, the first compression chamber V1, which is the corresponding compression chamber starts a compression stroke. At this time, as the preceding vane 1351 has passed through the first bypass hole 1312*c*, the first bypass hole 1312*c* thus communicates with the first compression chamber V1. Then, the refrigerant in the first compression chamber V1 may be bypassed into the inner space of the casing 110 through the first bypass hole 1312*c* due to a difference between the pressure of the first compression chamber V1 and the internal pressure of the casing 110. In particular, when a liquid refrigerant is introduced into the first compression chamber V1 during the suction stroke or pressure of the first compression chamber V1 is abnormally increased due to an abnormal operation of the refrigeration cycle apparatus, the compression may be carried out in the first compression chamber V1 and thereby the pressure of the first compression chamber V1 may be increased higher than the internal pressure of the casing 110. Then, the refrigerant in the first compression chamber V1 may be bypassed into the inner space of the casing 110 through the first bypass hole 1312*c* in advance. As a result, an excessive increase in the pressure of the first compression chamber V1 may be suppressed.

Figure 16C:
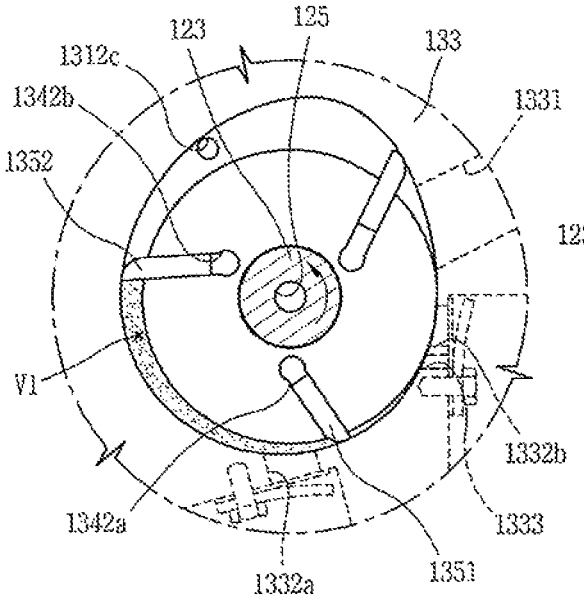

FIG. 16C illustrates a state in which both the first bypass hole 1312*c* and the second bypass hole 1333 are closed again from the compression chamber. As illustrated therein, the succeeding vane 1352 has just passed through the first bypass hole 1312*c* and the preceding vane 1351 has not yet reached the second outlet port 1332*b*. At this time, the first compression chamber V1 is in a state of undergoing the compression stroke and is closed from the first bypass hole 1312*c* and the second bypass hole 1333. Accordingly, while the refrigerant in the first compression chamber V1 is compressed, the refrigerant in the first compression chamber V1 is not bypassed into the inner space of the casing 110 through the first bypass hole 1312*c* and the second bypass hole 1333. Then, the compression stroke for the refrigerant in the first compression chamber V1 may smoothly proceed without any compression loss, thereby preventing in advance compressor efficiency from being lowered.

Figure 16D:
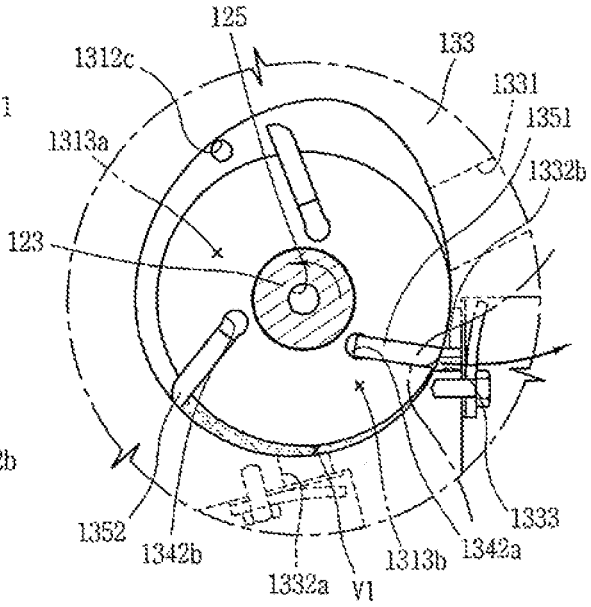

FIG. 16D illustrates a state in which the second bypass hole 1333 is closed. As illustrated therein, the preceding vane 1351 has just passed through the second bypass hole 1333 and has not yet reached the second outlet port 1332*b*. Then, since the first compression chamber V1 as the corresponding compression chamber has already passed through the first outlet port 1332*a*, a discharge stroke is continued. At this time, the first compression chamber V1 is in a state of communicating with the second bypass hole 1333 but not communicating with the second outlet port 1332*b*. Then, the refrigerant in the first compression chamber V1 may be bypassed into the inner space of the casing 110 through the second bypass hole 1333 due to difference between pressure of the first compression chamber V1 and internal pressure of the casing 110. Accordingly, the refrigerant in the first compression chamber V1 can be partially bypassed even when the first compression chamber V1 is not in communication with the second outlet port 1332*b*, which may result in suppressing the excessive increase in the pressure of the first compression chamber V1 as described with reference to FIG. 16B.

Embodiments disclosed herein provide a vane rotary compressor, capable of enhancing reliability of a mechanism and expanding an operation range by quickly discharging a refrigerant from a compression chamber when over-compression occurs in the compression chamber. Embodiments disclosed herein further provide a vane rotary compressor having a bypass hole, through which a refrigerant in a compression chamber may be discharged in advance before the compression chamber reaches an outlet port.

Embodiments disclosed herein provide a vane rotary compressor having a bypass hole at a position where a refrigerant in a compression chamber is discharged in advance without a suction loss or a compression loss. Embodiments disclosed herein also provide a vane rotary compressor, capable of preventing over-compression by allowing a refrigerant in a compression chamber to be discharged in advance before reaching an outlet port when using a high-pressure refrigerant, such as R32, R410a, CO2, so as to enhance reliability of a mechanism and expand an operation range.

Embodiments disclosed herein provide a vane rotary compressor in which a distance between an inner circumferential surface of a cylinder and an outer circumferential surface of a roller varies according to rotation of the roller. At least one outlet port may be formed in the cylinder, and a through hole having an inner diameter smaller than an inner diameter of the outlet port and formed from the inner circumferential surface to an outer circumferential surface of the cylinder in a penetrating manner may be formed at an upstream side relative to the outlet port based on a rotational direction of the roller.

Embodiments disclosed herein provide a vane rotary compressor in which a distance between an inner circumferential surface of a cylinder and an outer circumferential surface of a roller varies according to rotation of the roller and bearing plates are coupled to both sides of the cylinder and the roller in an axial direction. At least one of the bearing plates may be provided with a through hole which has an inner diameter smaller than an inner diameter of an outlet port and is formed from an inner space to an outer space of a compression chamber in a penetrating manner.

Embodiments disclosed herein provide a vane rotary compressor that may include a plurality of bearing plates provided at both sides in an axial direction with a preset or predetermined interval, a cylinder disposed between the plurality of bearing plates and having at least one outlet port, a roller performing an eccentric rotary motion within the cylinder, and at least one vane slidably coupled to the roller and rotating together with the roller to be brought into contact with an inner circumferential surface of the cylinder, so as to form a compression chamber between an inner circumferential surface of the cylinder and an outer circumferential surface of the roller. A sub outlet port may be formed at a position not overlapping the outlet port to bypass a refrigerant of the compression chamber before the compression chamber reaches the outlet port.

In addition, embodiments disclosed herein provide a vane rotary compressor that may include a cylinder provided with an outlet port, a plurality of bearings coupled to both sides of the cylinder in an axial direction of the cylinder to form a compression space together with the cylinder, a rotational shaft radially supported by the plurality of bearings, a roller rotatably coupled to the rotational shaft and provided with a plurality of vane slots formed in a circumferential direction and each having one end opened to an outer circumferential surface thereof, a plurality of vanes slidably inserted into the vane slots of the roller, respectively, and protruding toward an inner circumferential surface of the cylinder to partition the compression space into a plurality of compression chambers, and a discharge valve coupled to the cylinder to open and close the outlet port. The compressor may further include a bypass hole formed in at least one of the plurality of bearings or formed in the cylinder to bypass a part of a refrigerant compressed in the compression chamber.

The bypass hole may include a first bypass hole formed in at least one of the plurality of bearings. The first bypass hole may be formed at a first position to communicate with the compression chamber while a compression stroke is carried out in the compression chamber.

The first position may be located between a point at which a suction stroke for the compression chamber is completed and a point at which a discharge stroke is started. The first position may satisfy $\theta 1 \leq P2 \leq \theta 2$ when a contact point where an outer circumferential surface of the roller is located closest to an inner circumferential surface of the cylinder is 0 degree, $\theta 1$ is [360/the number of vanes (n)], and $\theta 2$ is [$\theta 1$+a suction complete position angle of a first vane from the contact point based on a rotational direction of the rotational shaft].

The bypass hole may have an inner diameter smaller than or equal to a width of the vane. The bypass hole may include a second bypass hole formed in the cylinder, and the second bypass hole may be formed at a second position in communication with the compression chamber while the discharge stroke is carried out in the compression chamber.

The outlet port may be provided in plurality disposed along a movement path of the compression chamber, and the second position may be located between a main outlet port closest to the contact point, which is a position where the outer circumferential surface of the roller is located closest to the inner circumferential surface of the cylinder, and a sub outlet port closest to the main outlet port.

An angle θ3 between a normal center line of the second position and a normal center line of the main outlet port may be formed within 25°.

The second bypass hole may be located outside an opening and closing range of a discharge valve that opens and closes the main outlet port. The second bypass hole may be formed at a position where at least part thereof overlaps a discharge valve that opens and closes the main outlet port.

The discharge valve may include a fixed part or portion fixed to the cylinder, an elastic part or portion that extends from the fixed part, and an opening and closing part or portion that extends from the elastic part to open and close the main outlet port. The second bypass hole may be formed at a position overlapping the elastic part, and have an inner diameter equal to or greater than a width of the elastic part. The second bypass hole may be formed such that a portion not covered by the elastic part is narrower than or equal to a portion covered by the elastic part.

The discharge valve may include a fixed part or portion fixed to the cylinder, an elastic part or portion that extends from the fixed part, and an opening and closing part or portion that extends from the elastic part to open and close the main outlet port. The second bypass hole may be formed to be located at at least one of both sides of the elastic part in an axial direction of the elastic part, without being covered by the elastic part.

The bypass hole may include a first bypass hole formed in at least one of the plurality of bearings and a second bypass hole formed in the cylinder. The second bypass hole may have an area larger than or equal to that of the first bypass hole.

The first bypass hole may be formed at a first position in communication with the compression chamber during a compression stroke of the compression chamber. The second bypass hole may be formed at a second position in communication with the compression chamber while a discharge stroke is carried out in the compression chamber.

Embodiments disclosed herein provide a vane rotary compressor that may include a cylinder, a plurality of bearings coupled to both sides of the cylinder in an axial direction of the cylinder to form a compression space together with the cylinder, a rotational shaft radially supported by the plurality of bearings, a roller coupled to the rotational shaft to be rotatable and having a plurality of vane slots formed in a circumferential direction and each having one end opened to an outer circumferential surface thereof, a plurality of vanes slidably inserted into the vane slots of the roller, respectively, and protruding toward an inner circumferential surface of the cylinder to partition the compression space into a plurality of compression chambers, an outlet port to guide a refrigerant compressed in the compression space to be discharged to outside of the compression space, and at least one bypass hole formed at an upstream side relative to the outlet port based on a rotational direction of the roller to bypass a part of the refrigerant compressed in the compression space. The outlet port may be provided in plurality disposed along the rotational direction of the roller, and the bypass hole may be provided by at least one in number between the plurality of outlet ports.

In a vane rotary compressor according to embodiments, a through hole, which defines a bypass hole at an upstream side relative to an outlet port based on a rotational direction of a roller, may be formed around a main frame, a sub frame, or the outlet port. Accordingly, an additional discharge passage may be additionally provided in addition to an outlet port which is opened and closed by a discharge valve, so as to prevent over-compression in a compression chamber in advance, thereby enhancing reliability of the compressor and expanding an operation region. In addition, as the bypass hole is formed in the vane rotary compressor disclosed herein, appropriate pressure may be maintained in the compression chamber in the case of using a high-pressure refrigerant, such as R32, R410a, or CO2, thereby enhancing reliability of the compressor and expanding an operation range.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vane rotary compressor, comprising:

a cylinder provided with at least one outlet port;

a plurality of bearings coupled to both sides of the cylinder in an axial direction of the cylinder to form a compression space together with the cylinder;

a rotational shaft radially supported by the plurality of bearings;

a roller rotatably coupled to the rotational shaft and provided with a plurality of vane slots formed in a circumferential direction, each having a first end opened to an outer circumferential surface thereof;

a plurality of vanes slidably inserted into the plurality of vane slots of the roller, respectively, and protruding toward an inner circumferential surface of the cylinder to partition the compression space into a plurality of compression chambers, respectively;

a discharge valve coupled to the cylinder to open and close the at least one outlet port; and a first bypass hole formed in the cylinder to bypass a portion of a refrigerant compressed in the compression chamber, wherein a valve groove is formed on an outer circumferential surface of the cylinder, wherein the at least one outlet port and the first bypass hole are formed in the valve groove to pass through the inner circumferential surface of the cylinder, wherein the at least one outlet port is opened and closed by the discharge valve, and wherein at least a portion of the first bypass hole is formed outside of a path of the discharge valve.

2. The vane rotary compressor of claim 1, further comprising a second bypass hole formed in at least one of the plurality of bearings, wherein the second bypass hole is formed at a first position in communication with the compression chamber while a compression stroke is carried out in the compression chamber, and wherein the second bypass hole is formed at an upstream side of the first bypass hole formed in the cylinder based on a rotational direction of the rotational shaft.

3. The vane rotary compressor of claim 2, wherein the first position is located between a point at which a suction stroke for the compression chamber is completed and a point at which a discharge stroke is started.

4. The vane rotary compressor of claim 3, wherein the first position satisfies $\theta 1 < P2 < \theta 2$ when a contact point where the outer circumferential surface of the roller is located closest to the inner circumferential surface of the cylinder is 0 degree, $\theta 1$ is [360/a number of the plurality of vanes (n)], and $\theta 2$ is [$\theta 1$+a suction complete position angle of a first vane from the contact point based on a rotational direction of the rotational shaft].

5. The vane rotary compressor of claim 4, wherein each of the first bypass hole and the second bypass hole has an inner diameter smaller than or equal to a width of the plurality of vanes.

6. The vane rotary compressor of claim 2, wherein the first bypass hole is formed at a second position in communication with the compression chamber while the discharge stroke is carried out in the compression chamber.

7. The vane rotary compressor of claim 6, wherein the at least one outlet port comprises a plurality of outlet ports disposed along a movement path of the compression chamber, and wherein the second position is located between a main outlet port of the plurality of outlet ports closest to a contact point, at which the outer circumferential surface of the roller is located closest to the inner circumferential surface of the cylinder, and a sub outlet port closest to the main outlet port.

8. The vane rotary compressor of claim 7, wherein an angle between a normal center line of the second position and a normal center line of the main outlet port is formed within 25°.

9. The vane rotary compressor of claim 7, wherein the first bypass hole is located outside of an opening and closing range of the discharge valve that opens and closes the main outlet port.

10. The vane rotary compressor of claim 7, wherein the second first bypass hole is formed at a position at which at least a portion of the first bypass hole overlaps the discharge valve that opens and closes the main outlet port.

11. The vane rotary compressor of claim 10, wherein the discharge valve includes a fixed portion fixed to the cylinder, an elastic portion that extends from the fixed portion, and an opening and closing portion that extends from the elastic portion to open and close the main outlet port, and wherein the first bypass hole is formed at a position overlapping the elastic portion, and has an inner diameter equal to or greater than a width of the elastic portion.

12. The vane rotary compressor of claim 11, wherein the first bypass hole is formed such that a portion of the first bypass hole not covered by the elastic portion is narrower than or equal to a portion of the first bypass hole covered by the elastic portion.

13. The vane rotary compressor of claim 10, wherein the discharge valve includes a fixed portion fixed to the cylinder, an elastic portion that extends from the fixed portion, and an opening and closing portion that extends from the elastic portion to open and close the main outlet port, and wherein the first bypass hole is formed to be located at least one of both sides of the elastic portion in an axial direction of the elastic portion, without being covered by the elastic portion.

14. The vane rotary compressor of claim 1, further comprising a second bypass hole formed in at least one of the plurality of bearings, wherein the first bypass hole has an area larger than or equal to an area of the second bypass hole.

15. The vane rotary compressor of claim 14, wherein the second bypass hole is formed at a first position in communication with the compression chamber while a compression stroke is carried out in the compression chamber, and wherein the first bypass hole is formed at a second position in communication with the compression chamber while a discharge stroke is carried out in the compression chamber.

16. A vane rotary compressor, comprising:

a cylinder;

a plurality of bearings coupled to both sides of the cylinder in an axial direction of the cylinder to form a compression space together with the cylinder;

a rotational shaft radially supported by the plurality of bearings;

a roller coupled to the rotational shaft to be rotatable and having a plurality of vane slots formed in a circumferential direction, each having a first end opened to an outer circumferential surface thereof;

a plurality of vanes slidably inserted into the plurality of vane slots of the roller, respectively, and protruding toward an inner circumferential surface of the cylinder to partition the compression space into a plurality of compression chambers, respectively;

at least one outlet port to guide a refrigerant compressed in the compression space to be discharged to outside of the compression space; and at least one bypass hole formed at an upstream side relative to the at least one outlet port based on a rotational direction of the roller to bypass a portion of the refrigerant compressed in the compression space, wherein the at least one outlet port includes a plurality of outlet ports disposed along a movement path of the compression chamber, wherein the at least one bypass hole is formed at a position located between a main outlet port of the plurality of outlet ports closest to a contact point, at which the outer circumferential surface of the roller is located closest to the inner circumferential surface of the cylinder, and a sub outlet port closest to the main outlet port, and wherein an angle between a normal center line of the at least one bypass hole and a normal center line of the main outlet port is formed within 25°.

17. The vane rotary compressor of claim 16, wherein the plurality of outlet ports is disposed along the rotational direction of the roller, and wherein the at least one bypass hole is provided between the plurality of outlet ports.

18. A vane rotary compressor, comprising:

a cylinder provided with at least one outlet port;

a plurality of bearings coupled to both sides of the cylinder in an axial direction of the cylinder to form a compression space together with the cylinder;

a rotational shaft radially supported by the plurality of bearings;

a roller rotatably coupled to the rotational shaft and provided with a plurality of vane slots formed in a circumferential direction, each having a first end opened to an outer circumferential surface thereof;

a plurality of vanes slidably inserted into the plurality of vane slots of the roller, respectively, and protruding toward an inner circumferential surface of the cylinder to partition the compression space into a plurality of compression chambers, respectively;

at least one discharge valve coupled to the cylinder to open and close the at least one outlet port;

a first bypass hole formed in at least one of the plurality of bearings; and a second bypass hole formed in the cylinder, wherein the first bypass hole is formed at a first position in communication with the compression chamber while a compression stroke is carried out in the compression chamber, and wherein the second bypass hole is formed at a second position in communication with the compression chamber while a discharge stroke is carried out in the compression chamber, wherein the first position satisfies $\theta 1 \leq P2 \leq \theta 2$ when a contact point where the outer circumferential surface of the roller is located closest to the inner circumferential surface of the cylinder is 0 degree, $\theta 1$ is [360/a number of the vanes (n)], and $\theta 2$ is [$\theta 1$+a suction complete position angle of a first vane from the contact point based on a rotational direction of the rotational shaft].

19. The vane rotary compressor of claim 18, wherein the at least one outlet port comprises a plurality of outlet ports, including a main outlet port and a sub outlet port, disposed along a movement path of the compression chamber, wherein the at least one discharge valve comprises a plurality of corresponding discharge valves, and wherein the second position is located between the main outlet port closest to a contact point, at which the outer circumferential surface of the roller is located closest to the inner circumferential surface of the cylinder, and the sub outlet port, outside an opening and closing range of the corresponding plurality of discharge valves that opens and closes the main outlet port.

* * * * *